US011125220B2

(12) United States Patent
Petrus

(10) Patent No.: US 11,125,220 B2
(45) Date of Patent: Sep. 21, 2021

(54) PUMP UNIT COMPRISING AN OUTER PART, AN INNER PART, AND A TOP PART WITH A PISTON, WHEREIN THE PISTON EXTENDS INTO THE INNER PART AND THE TOP PART IS ARRANGED TO PERFORM A SCROLLING MOVEMENT WHEREBY THE INNER PART IS CAUSED TO SLIDE IN A FIRST DIRECTION RELATIVE TO THE OUTER PART

(71) Applicant: Norlin Petrus, Nacka (SE)

(72) Inventor: Norlin Petrus, Nacka (SE)

( * ) Notice: Subject to any disclaimer, the term of this patent is extended or adjusted under 35 U.S.C. 154(b) by 12 days.

(21) Appl. No.: 16/318,379

(22) PCT Filed: Jul. 12, 2017

(86) PCT No.: PCT/SE2017/000031
§ 371 (c)(1),
(2) Date: Jan. 17, 2019

(87) PCT Pub. No.: WO2018/017004
PCT Pub. Date: Jan. 25, 2018

(65) Prior Publication Data

US 2019/0242371 A1 Aug. 8, 2019

(30) Foreign Application Priority Data

Jul. 20, 2016 (SE) ..... 1630113-7

(51) Int. Cl.
*F04B 23/06* (2006.01)
*F04B 7/04* (2006.01)
(Continued)

(52) U.S. Cl.
CPC ..... *F04B 23/06* (2013.01); *F04B 7/04* (2013.01); *F04B 9/04* (2013.01); *F04B 19/027* (2013.01); *F04C 2/02* (2013.01)

(58) Field of Classification Search
CPC ..... F04B 19/02; F04B 19/022; F04B 3/003; F04B 1/113; F04B 1/1136; F04B 27/02;
(Continued)

(56) References Cited

U.S. PATENT DOCUMENTS 750,336 A * 1/1904 Bentz ..... F01B 9/023 123/74 R
968,126 A * 8/1910 Clark ..... F04B 19/022 417/466

(Continued)

FOREIGN PATENT DOCUMENTS

DE 2628840 A1 1/1978

*Primary Examiner* — Patrick Hamo
*Assistant Examiner* — Benjamin Doyle

(57) ABSTRACT

A pump unit (1*a*) comprising a cavity (6*a*) defined by an immobile part (17), a reciprocating part (16), and a top element (18) sealing the cavity to define a chamber. The top element is fixedly attached to a scrolling piston wall (5*a*), slidably disposed within the cavity to move perpendicularly relative the chamber, dividing it in two sealed subchambers, the chamber following the reciprocating parts component of the piston wall, along the immobile part. Each subchamber has inlets and outlets on the immobile part, that are alternately exposed and covered as the reciprocating part and the piston wall moves.

15 Claims, 15 Drawing Sheets

(51) Int. Cl.
*F04B 9/04* (2006.01)
*F04B 19/02* (2006.01)
*F04C 2/02* (2006.01)

(58) Field of Classification Search
CPC ..... F04B 39/0027; F04B 7/04; F04B 9/042; F04B 9/047; F04B 23/06; F04B 3/00; F01B 15/02; F01B 7/20; F01B 9/023; F02B 2075/025; F02B 2075/1808; F02B 25/00; F02B 3/06; F02B 57/08; F02B 59/00; F16N 13/02; Y10T 137/8667; F04C 2/00
USPC ..... 417/490; 92/165 R, 169.1
See application file for complete search history.

(56) References Cited

U.S. PATENT DOCUMENTS 1,410,129 A * 3/1922 Saussard ..... F16N 13/02 417/468
1,435,224 A * 11/1922 Gensecke ..... F04B 27/02 417/491
1,622,816 A * 3/1927 Sperry ..... F04B 3/006 417/463
2,130,037 A * 9/1938 Skarlund ..... F01B 7/20 91/173
2,258,379 A * 10/1941 Estey ..... F01B 7/20 91/173
2,504,945 A * 4/1950 Austin ..... F04B 3/003 417/250
2,574,921 A * 11/1951 Johnson ..... F04B 3/006 417/463
3,056,356 A * 10/1962 Piper ..... F04B 1/1136 417/462
3,630,178 A * 12/1971 Erickson ..... F02B 59/00 123/256
3,630,646 A * 12/1971 Connolly ..... F04B 19/02 417/466
3,799,035 A * 3/1974 Lamm ..... F02B 57/08 91/493
3,878,768 A * 4/1975 Kress ..... F16H 43/00 92/2
3,878,821 A * 4/1975 White ..... F02B 59/00 123/61 R
4,008,982 A 2/1977 Traut
4,110,060 A * 8/1978 Erickson ..... F04B 3/003 417/462
4,637,786 A 1/1987 Matoba et al.
4,767,294 A 8/1988 Munt, III
5,114,321 A * 5/1992 Milburn ..... F04B 19/02 417/467
5,131,824 A * 7/1992 Richardson, Jr. ..... F04B 9/047 417/526
5,779,452 A * 7/1998 McCombie ..... F01B 15/02 137/625.25
8,182,247 B2 * 5/2012 Gallwey ..... F04B 9/042 417/521
2005/0244280 A1 11/2005 Malone et al.
2005/0260092 A1 11/2005 Bolger
2013/0078127 A1 * 3/2013 Pawellek ..... F04C 2/00 418/31
2018/0087720 A1 * 3/2018 Froehler ..... F04B 17/03
2020/0124036 A1 * 4/2020 Pawellek ..... F04B 7/04

* cited by examiner

PUMP UNIT COMPRISING AN OUTER PART, AN INNER PART, AND A TOP PART WITH A PISTON, WHEREIN THE PISTON EXTENDS INTO THE INNER PART AND THE TOP PART IS ARRANGED TO PERFORM A SCROLLING MOVEMENT WHEREBY THE INNER PART IS CAUSED TO SLIDE IN A FIRST DIRECTION RELATIVE TO THE OUTER PART

TECHNICAL FIELD

The present invention relates to the technique of valve-free scrolling positive displacement pumps and a compressor unit comprising at least two such pumps.

BACKGROUND

In pumps of this kind, the arrangement of the inlet and outlet ports is often very complicated with many moving parts and hence they are prone to wear. Often, the ports are small and open slowly, the pistons, and thus also the cavities are large relative to the stroke volume, which leads to large losses due to friction as large amounts of gas pass through small ports, but also because of large contact areas between the elements.

In summary, prior art pumps of this type are typically volume inefficient, provide friction and have many moving parts. This makes them unsuitable for use as compressors.

U.S. Pat. No. 467,294 discloses a pump having an immobile outer chamber with its own pumping flow. The inlet and outlet of this chamber are exposed or covered periodically by an inner piston/inner cavity. The inner cavity must therefore be large enough to cover the connections, which means either a large housing or small connections while at the same time the inner cavity must move adjacently to the outer chamber walls, since the inner chamber divides the outer housing into two sealed chambers, which creates friction.

U.S. Pat. No. 2,130,037 discloses a pump in which a rotating axis causes two inner parts to scroll within a pump housing, thereby exposing and closing inlets and outlets to the pump housing.

SUMMARY

It is an object of the present invention to provide an improved pump in particular in terms of friction, wear, fluid flow rate and/or volume efficiency.

The invention proposes a scrolling pump having the features of claim 1.

The invention relates to a pump unit comprising a cavity delimited by a mainly motionless outer part, an inner part moving back and forth relative to the outer part and a top element closing the cavity. There is also a piston wall firmly attached to the top element that goes into the cavity and fits sealingly against its walls.

On the outer part a number of connectors for fluid are located. In a preferred embodiment, there are four connectors: two intended inputs and two intended outputs. These are covered by the inner part in certain vertical positions and exposed in other positions of the inner part's movement relative to the outer part.

The top elements scrolling motion brings the inner part and the cavity to move reciprocatingly along the outer part. The cavity and the piston are so shaped so that the piston with ease can slip between the side ends of the cavity, the piston only moves laterally relative to the cavity.

By placing the connectors in appropriate positions, an output and input will be exposed on each side of the piston in the cavity, at the same time as the piston of the cavity moves toward the outputs and from the inputs. The same applies when the piston changes direction but with the other outputs and inputs exposed, because the inner part is in a new position.

Hence, according to the invention, a scrolling movement of one element causes a translational movement of another element, so that connections are exposed and covered, which together with a scrolling piston creates a pumping effect.

The construction of the pump according to the present invention minimizes friction in that it comprises a movable cavity confined by a translating inner part, a fixed outer part and a top element, wherein the inner part moves translatingly along the outer part and the top element moves translatingly relative to the inner part. No separate valve elements are needed, which eliminates a part that is prone to fail because of wear and tear. Instead, the valve function is performed by interaction between the inner part and the outer part and is therefore built into the pump design.

The pump according to the present invention may work at high speed and needs few moving parts when compared to prior art pumps. Furthermore, it is considerably more volume efficient, can achieve greater stroke length relative to piston size, but can also be designed to achieve large flow with small stroke length, compared to prior art pumps of this type. The invention provides solutions for making the passages in and out of the cavity grow and shrink quickly even with small movements, which means that the pumping can take place at a high speed.

In a preferred embodiment, the cavity includes a frame bottom following the movement of the cavity, and may be sealed, except for in strategic positions, without fixed outer elements. Therefore, the contact surfaces between moving and fixed elements can be limited to a minimum that only periodically covers said fixed elements connections. In addition, this embodiment has a plurality of openings, each opening located at the same distance from its corresponding connection, so even a small movement corresponds to several opened passages, instead of just one, which gives a greater total passage area. In addition, power transmission and controlling contact surfaces between moving elements are placed in positions that do not need to be sealed, therefore these surfaces can be provided with friction reducing means.

It should also be added that in the case of a piston attached to the top element, it is possible to use the technique commonly used in scroll compressors, where no moving parts are used as a driving device. The whole device may be powered by a spinning magnetic field, causing the top element part to scroll.

The device can advantageously be implemented in several steps to become a compressor that can be used in existing scrolling devices Thanks to its volume efficiency, several cavities can easily be interconnected to act as one large cavity to form one pump unit without taking up more space one of the prior art pumps. A compressor may be formed by connecting the outlet from said several cavities into cavities with a total smaller volume. In the event that the device is composed of two pump elements, of different sizes, it can advantageously also be used as a compressor or expander. It is also very easy to cool down the gas during the compression phase of this compressor. If the cavities are connected differently, the compressor gets a different ratio.

By interconnecting several cavities, a variable compression ratio, or pump power may be achieved in different ways, without changing the moving parts of the pump. To exclude a particular cavity from the flow, interconnecting the two sides of the cavity will make it inoperative.

Moreover, the present invention is more flexible and can easily be converted into a 4-chamber pump. This by adding an additional translating inner part, turning it 90° relative to the first, adding a corresponding piston wall rotated 90° relative to the first one and placing them on said existing top elements, with corresponding connections on the solid element. This results in a 4-piston pump.

A common top element may be used, which may have multiple pistons attached to it. Then only one element has to be controlled. In theory, the piston can scroll as high or wide as needed. No holes with shoulders need to be covered and an arbitrary number of cavities may be arranged on the same inner part, as they rather stabilize like a wide piston than vice versa. In addition, since it is mainly the inner part that exposes and covers the connections there is no theoretical minimum width of the piston

BRIEF DESCRIPTION OF THE DRAWINGS

The invention will be described in more detail in the following, by way of example and with reference to the appended drawings, in which.

DETAILED DESCRIPTION

Figure 1:
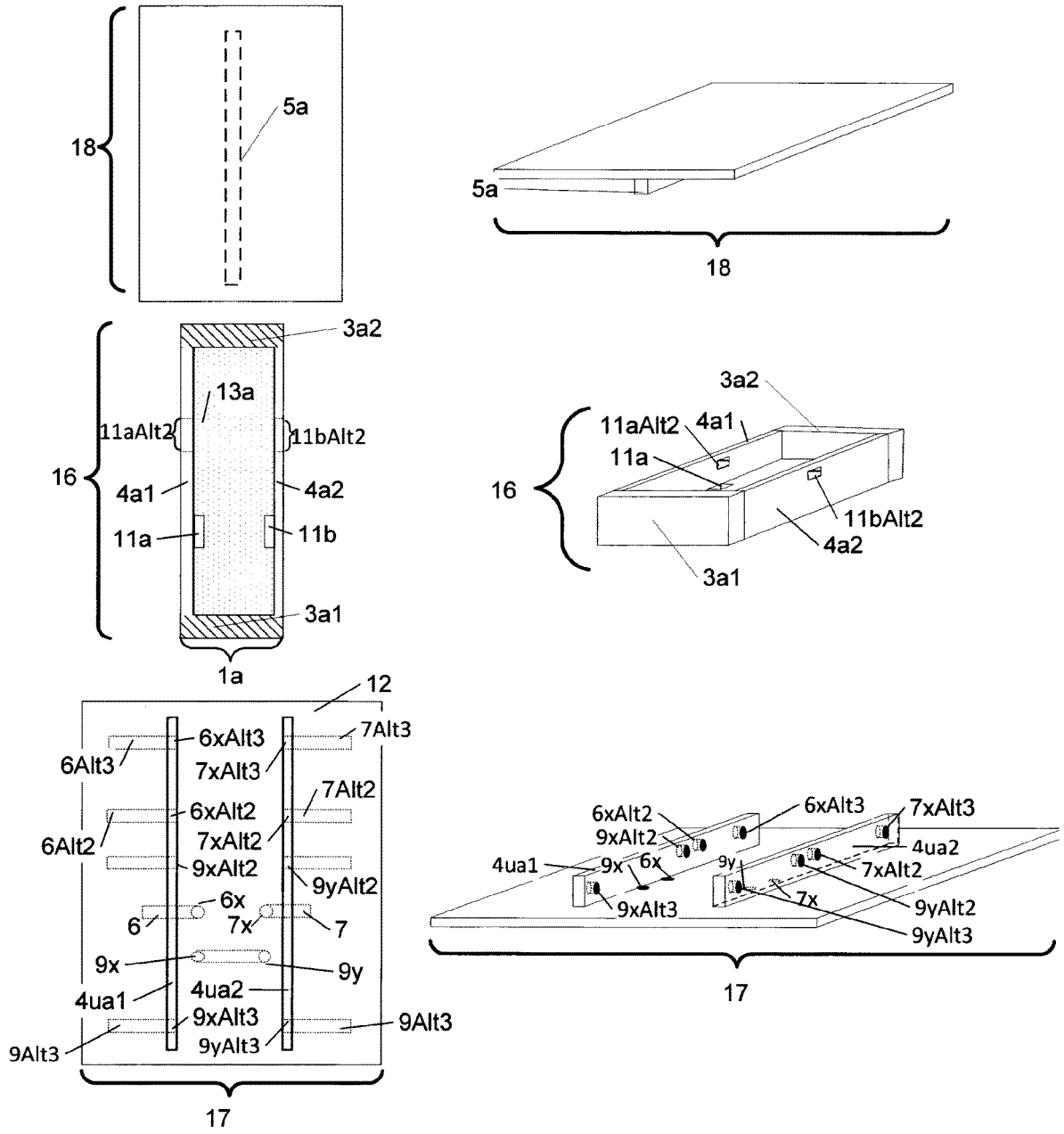
FIG. 1 shows an embodiment of a pump unit comprising most described wall types and connection types, to be used as a reference in the description.

In general, the pump according to the invention comprises a mainly fixed outer part 17 with a number of connections, an inner part 16, which can only move translatingly, sliding against at least a sub-part of the outer part, and a top element closing the cavity formed by the inner 16 and outer 17 parts. These reference numerals are used in all Figures. The cavity is completely sealed, except for the fluid inlets and outlets. Attached to the top element is a piston wall extending into the cavity and dividing into two chambers, which are sealed against each other. The movement of the inner part can be achieved with some form of tracking or similar in the outer part. Also, the outer part has openings in the walls so that the inner part can expose or cover the connections depending on their position in the direction parallel to the side walls, that is, the vertical direction in the Figure.

On the outer part, there should be at least four connectors, two intended inputs and two intended outputs. These are covered by the inner part in certain vertical positions and are exposed in other vertical positions of the inner part relative to the outer part. The top element's scrolling motion causes the inner part to move vertically, with reference to the directions in the drawing.

It should be noted that all references in this document to upper and lower inlets and outlets, upper and lower end stops, and upper and lower positions of the end stops refer to how they are shown the drawings and not to the position of the relevant element in the actual pump unit.

By placing the openings so an input connection 6*x* is exposed to the left at the same time as an output 7*x* is exposed on the other side of the cavity, while the piston wall moves to the right, relative to the cavity, the piston wall sucks fluid into the left-hand chamber at the same time as it ejects fluid from the right-hand chamber. If ensuring that the openings 6*x* and 7*x* are exposed throughout the piston wall motion to the right, and if ensuring that this motion corresponds to a whole stroke, all fluid in the right side of the piston be drained through the connection 7*x*, and the left chamber of the cavity will be filled from the opening 6*x*.

By placing the connections so that a new output 9*x* is exposed to the left (as seen in the drawing) at the same time with a new input 9*y* on right-hand side of the piston wall in the cavity, in connection with the piston turning and moving towards the left side of cavity, the piston wall will eject the above described fluid from the left chamber through the opening 9*x*, at the same time as it sucks in new fluid in the right chamber via opening 9*y*.

If the outlet 9*x* from the left-hand chamber is cross-connected with the inlet 9*y* of the right-hand chamber, the gas sucked into the left-hand chamber, is moved to the right-hand side of the cavity and then at the next cycle when the piston will begin to move to the right again, fluid will be pumped out from the cavity's right-hand side through connection 7*x*. If both the outlets 7*x* and 9*x* are engaged away from the cavity, twice the fluid will be moved through the cavity per cycle instead. In both cases a pump effect is achieved without actual valves.

The bottom and top plate, side walls, end stops and piston are arranged relative to each other in a sealing way so that fluids cannot pass between these elements without being forced through the relevant openings. Pump elements can also act in a pump direction opposite to that of this description, so the directions may be reversed relative to the indication of inlets and outlets. The cavity may be formed in different ways, with the walls of the cavity being distributed between the inner and outer parts in different ways.

FIG. 1 shows a first basic embodiment of the invention, in which the inner part forms a sealed cavity. In this first embodiment, the inner part 16 comprises two horizontal moveable end stops 3*a*1 and 3*a*2 arranged on a frame bottom 13*a* illustrated symbolically as a rectangle surrounding the entire inner part. The end stops extend in parallel with each other. Between the end stops two vertical side walls 4*a*1 and 4*a*2 are arranged are arranged so together with the end stops and the frame bottom they form a cavity.

The outer part 17 comprises two vertical outer side walls 4*a*1 and 4*a*2, arranged on the bottom element 12 which is illustrated symbolically as a rectangle surrounding the whole pump unit.

The inner part is caused to slide along the outer part between the outer side walls 4*ua*1 and 4*ua*2, and parallel to their main extension. The inner part can slide freely back and forth in the space between the outer side walls and during the movement against the bottom element 12. Since the end stops 3*a*1, 3*a*2 are connected to each other, the movement of one end stop in a pump unit forces the other end stop to move in the same way.

This new space arising is limited by a combination of walls from the outer and inner part. In one possible variation of this embodiment the inner part does not have side walls. One or both side walls 4*a*1, 4*a*2 may be removed. In this case the two end stops instead slide against the outer sidewall throughout their movement and the cavity is limited by the outer side wall. The inner part can also be made without the frame bottom 13A. In this case, the cavity will be limited by the bottom element and the entire inner part will slide against the bottom element 12.

Similarly, if the outer part does not comprise a bottom element 12, the inner part must have a frame bottom 13*a*. If the outer part does not have an outer sidewall 4*ua*1, 4*ua*2, the inner part must have the corresponding sidewall 4*a*1 or 4*ua*2, respectively.

The cavity formed in the pump element is divided into two parts by a piston wall 5*a* extending substantially parallel to the sidewalls. The piston is connected to a top plate located on top of the end stops and the side walls of the cavity. The top element closes the cavity and forms the closed space in which the pumping occurs. The top element is driven by a drive means to perform a scrolling movement which causes the piston to make move in a corresponding manner and forces the end stops to move back and forth, seen as up and down in the figure. The piston extends all the way between two interconnected end stops and since these can move back and forth inside the outer part, the components of the piston wall motion extending in parallel with the direction between the end stops also moves the end stops.

The inlets and outlets of the cavity of the embodiment described below are alternative methods to connect the inlets and outlets to the cavity. The following description applies to a clockwise scrolling of the top element. The skilled person could easily modify to a counter clockwise (CCW) scrolling movement.

The fluid enters the left chamber via the primary inlet 6, then goes out through the primary outlet 9. A different flow lets the fluid enter and leave the right chamber via the secondary inlet 7 and the secondary outlet 9, respectively. FIG. 1 shows a number of inlets 6Alt2, 6Alt3, and outlets 7Alt2, 7Alt3 that may be advantageous in some embodiments. For example, the inlets and outlets may be arranged in the outer side walls 4*ua*1, 4*ua*2 instead of in the bottom element 12.

A primary inlet 6 enters via a left upper connection 6*x* in the bottom element. This left upper connection is positioned in the space next to the piston walls left turning point in the direction perpendicular to the side walls.

If the inner part has a frame bottom, there will be an opening 11*a* on the frame bottom at the same distance from the side wall, the connection 6*x*, and the piston walls vertical movement will be such that the opening exposes the connection throughout the piston walls movement to the right, but not to the left. If the inner part does not have a frame bottom, the connection 6*x* will sit adjacent but below the upper end point of the top end stop and the piston walls vertical movement will be such that the connection is exposed throughout the piston wall movement to the right, but not to the left.

In this embodiment, if the inner part has a left side wall 4*a*1, there will be an opening 11*a*Alt2 on the left side wall at the same distance from the bottom as the connection 6*x*Alt2, and the piston wall elevational movement will be such that the opening exposes the connection under the entire piston wall movement to the right, but not to the left. If the inner part does not have a left side wall 4*a*1, the connection 6*x*Alt2 sits adjacent but below the upper end point of the top end stop and the piston wall vertical movement will be such that the connection is exposed throughout the piston wall movement to the right, but not to the left.

A primary outlet 9 is connected to a left lower connection 9*x* in the bottom element. This left lower connection is arranged in the space next to the piston walls left turning point perpendicular to the side wall.

If the inner part has a frame bottom, there will be an opening 11*a* on frame bottom at the same distance from the side wall, as the connection 9*x*, and the piston wall vertical movement will be such that the opening exposes the connection throughout the piston walls movement to the left, but not the right. The connection 9*x* then sits adjacent but above the lower end stops lower end point and the piston walls vertical movement will be such that the connection is exposed throughout the piston wall movement to the left, but not to the right.

In some embodiments, the outlet enters 6 in a left lower connection 9*x*Alt2 in the left outer side wall instead.

If the inner part has a left side wall 4*a*1, there will be an opening 11*a*Alt2 on the left side wall at the same distance from the bottom, as the connection 9*x*, and the piston wall vertical movement will be such that the opening exposes the connection during the entire piston wall movement to the left, but not right. The connection 9*x*Alt2 then sits adjacent but above the lower end stops lower end point and the piston walls vertical movement will be such that the connection is exposed throughout the piston wall movement to the left, but not to the right.

A secondary outlet 7 is connected to a connection 7*x* in the bottom element. This connection 7*x* is provided in the space next to the piston walls right turning point in the direction perpendicular to the side walls.

If the inner portion has a frame bottom, there will be an opening 11*b* on frame bottom at the same distance from the side wall, as the connection 7*x*, and the piston walls vertical movement will be such that the opening exposes the connection throughout the piston wall's movement to the right, but not to the left. If the inner part has a frame bottom, the connection 7*x* sit adjacent but below the top end stops upper end point and the piston wall's vertical movement will be such that the connection is exposed throughout the piston wall movement to the right, but not to the left.

In some embodiments, the outlet opening 7 is connected to a right upper connection 7*x*Alt2 on the right outer side wall instead.

In this embodiment, if the inner portion has a side wall 4*a*2, there will be an opening 11*b*Alt2 on the right side wall at the same distance from the bottom, as the connection 7*x*Alt2, and the piston wall's vertical movement will be such that the opening exposes the connection under the entire piston wall movement to the right, but not to the left.

In this embodiment, if the inner part has a right-side wall 4*a*2, the connection 7*x*Alt2 sits adjacent but below the top end stops upper end point and the piston wall vertical movement will be such that the connection is exposed throughout the piston wall movement to the right, but not to the left.

A secondary inlet 8 is connected to a connection 9*y* in the bottom element. This right upper connection is placed in the space next to the piston wall right turning point in the direction perpendicular to the side walls.

If the inner part has a frame bottom, there will be an opening 11*b* on frame bottom at the same distance from the side wall, as the connection 9*y*, and the piston wall vertical movement will be such that the opening exposes the connection throughout the piston walls movement to the left, but not the right. If the inner part has a frame bottom, the connection 9*y* sit adjacent but below the lower end stops lower end point and the piston walls vertical movement will be such that the connection is exposed throughout the piston walls movement to the left, but not to the right.

In some embodiments, inlet 8 opens into a right lower connection 9*y*Alt2 on the right outer side wall instead. If the inner portion has a side wall 4*a*2, there will be an opening 11*b*Alt2 on the right side wall at the same distance from the bottom, as the connection 9*y*Alt2, and the piston wall vertical movement will be such that the opening exposes the connection throughout the piston wall movement to the left, but not right. If the inner part has a side wall 4*a*2, the connection 9*y*Alt2 sits adjacent but above the lower end stops lower end point and the piston wall vertical movement will be such that the connection is exposed throughout the piston wall movement to the left, but not to the right.

Figure 2:
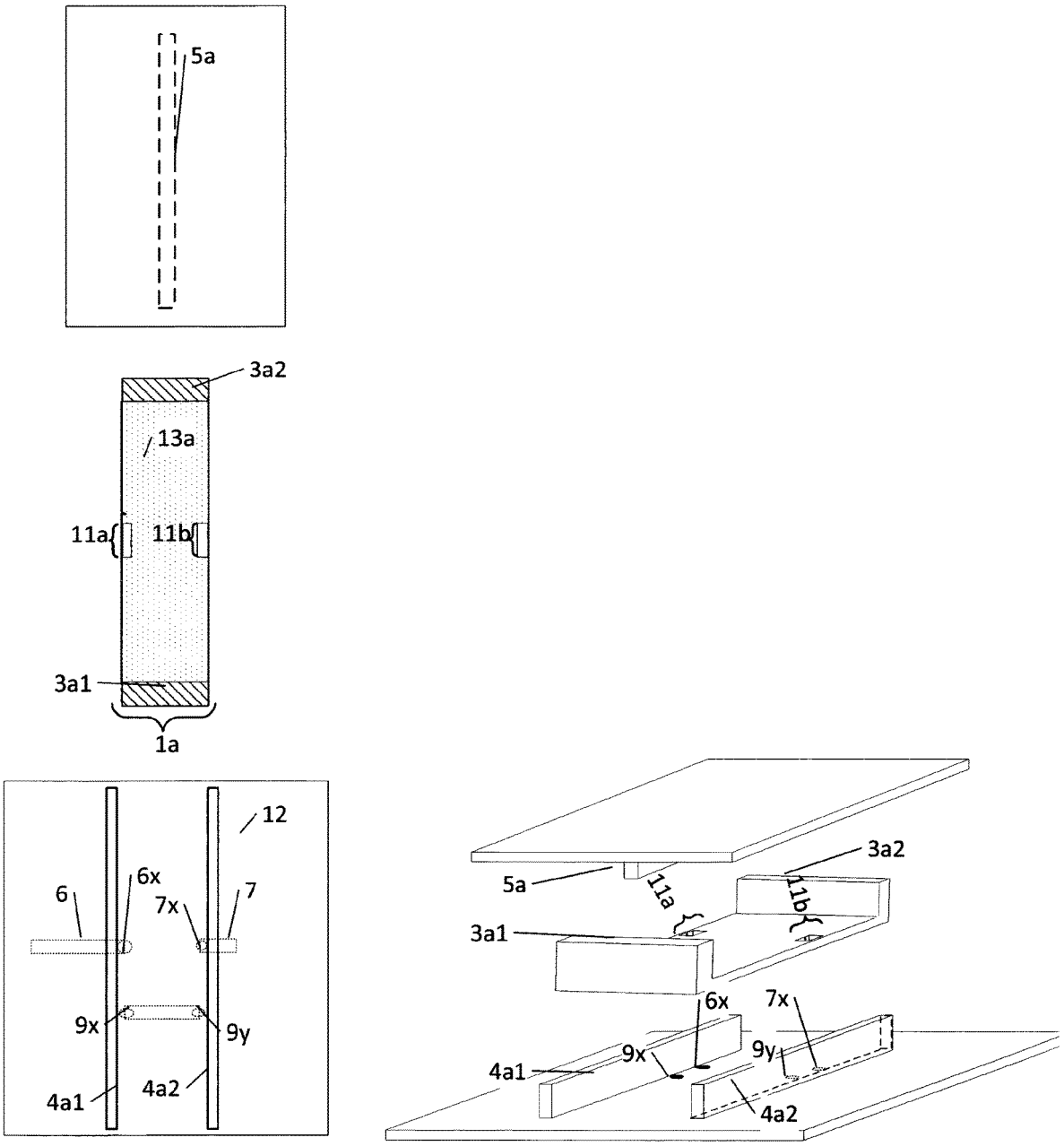
FIG. 2 illustrates a second embodiment of a pump unit according to the invention.

FIG. 2 illustrates the physical parts of a pump according to a second embodiment, in which there are no inner side walls. Instead the cavity is sealed by outer side walls. In this embodiment, the end stops are sealingly attached to the frame bottom at a distance of the corresponding piston height of partitions. The connections are located directly on the bottom element 12.

A hole 11*a* is located on the frame bottom next to the left outer sidewall 4*ua*1. A hole 11*b* is located on the frame bottom next to the right-hand outer sidewall 4*ua*2. Opening 6*x* is located next to the left outer sidewall 4*ua*1 close to the holes 11A's top end position. Opening 7*x* is located next to the right-hand outer sidewall 4*ua*2 close to the hole's 11*b* top end position. Opening 9*x* is located next to the left outer sidewall 4*ua*1 close to the holes 11*a* the lower end position. Opening 9*y* is located next to the right-hand outer sidewall 4*ua*2 close to the holes 11*b*'s lower end position. The inner part comprising the end stops with frame bottom slides freely back and forth between the sidewalls 4*a*1 and 4*a*2 in a direction parallel to the side walls.

When the frame bottom is in an upper position as seen in the drawing, the hole 11*a* coincides with 6*x* and the opening 11*b* coincides with 7*x*. When the frame bottom is in a lower position the hole 11*a* coincides with 9*x* and the opening 11*b* coincides with 9*y*.

The top element makes a scrolling movement and moves the end stops, with the frame bottom, so that when they are in its upper end position openings 9*x* and 9*y* covered by the frame bottom while inlets 6*x* and 7*x* are exposed so that when the piston moves from 6*x* to 7*x* fluid is ejected though 7*x* at the same time as the new fluid is sucked in through 6*x*.

When the top element scrolls and moves the end stops into the lower position, with the frame bottom, the upper connections 6*x* and 7*x* are covered by the frame bottom, at the same time as there is a passage connecting 9*x* and 9*y*, and these connections are exposed, when the piston moves from 9*y* towards 9*x*, fluid moves from the left to the right-hand side of the piston.

Please note that the openings 6*x* and 9*x* would be able to sit on the outer sidewall 4*ua*1, as well as the openings 7*x* and 9*y* could sit on the outer sidewall 4*ua*2. It would then be able to let the end stops open or cover the above openings instead.

Figure 3:
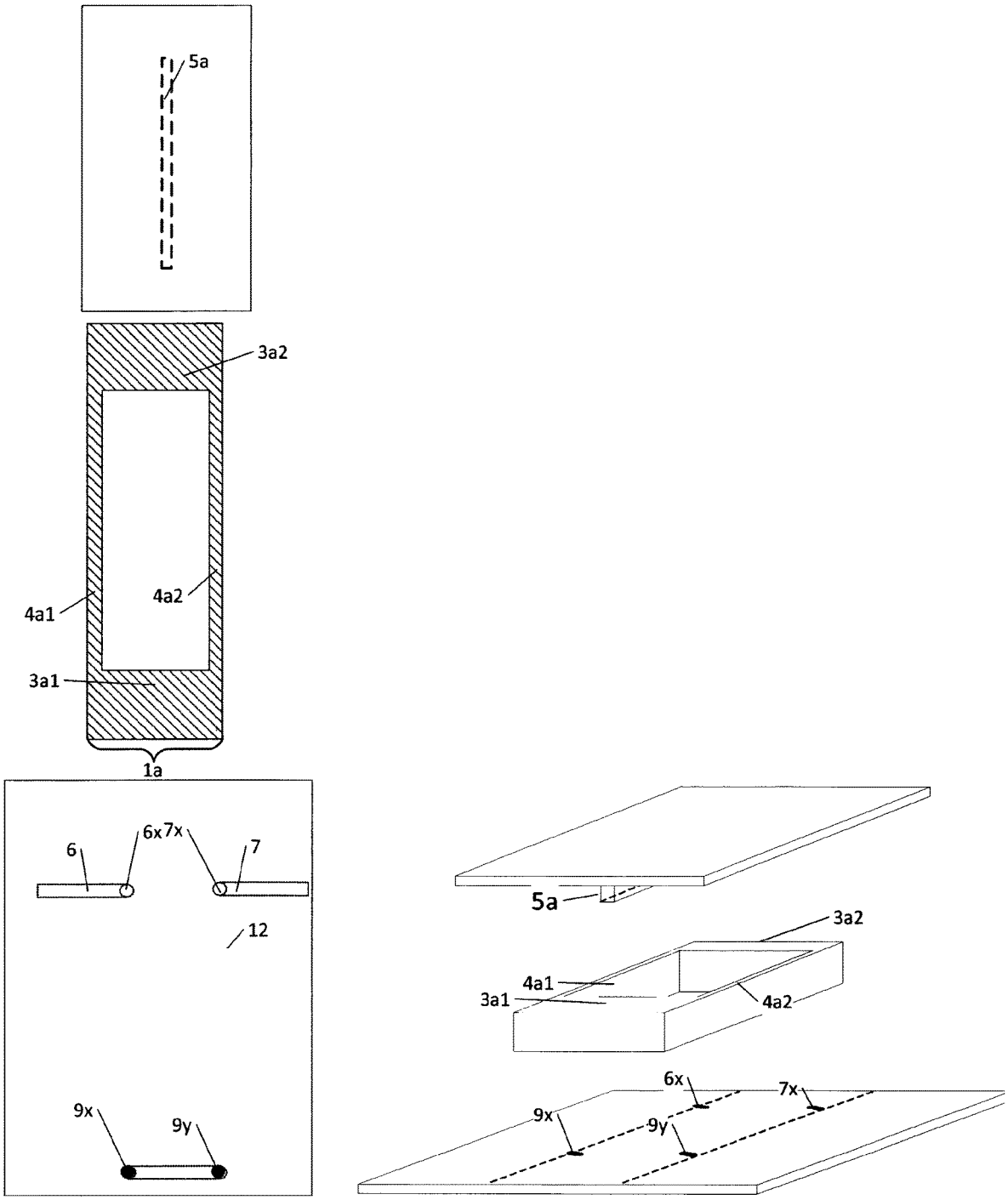
FIG. 3 illustrates a third embodiment of a pump unit according to the invention.

FIG. 3 shows yet another embodiment of the pump according to the invention. In this embodiment, the inner part does not comprise a frame bottom. The end stops are sealingly attached to the side walls 4*a*1 and 4*a*2 and slide vertically along the bottom element, so some form of tracking is needed to make the stops move vertically.

Figure 4:
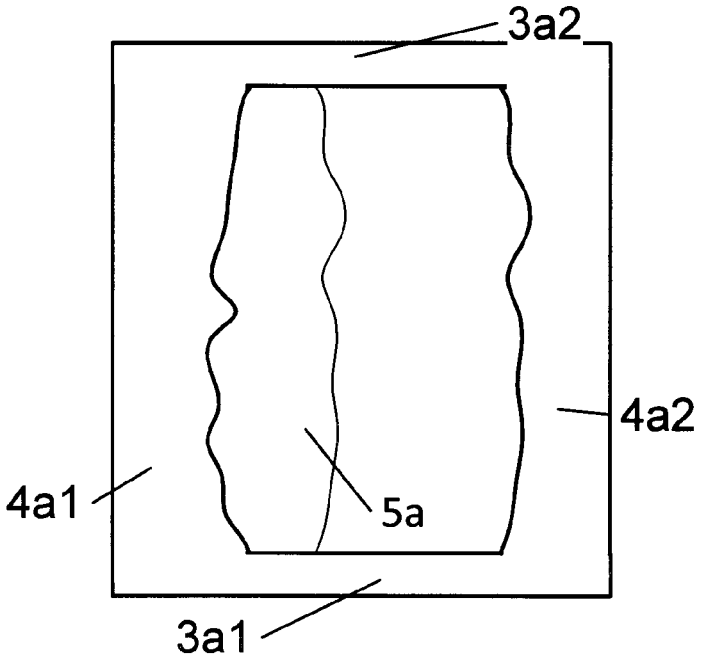
FIGS. 4 and 5 show an embodiment of a pump unit at two different steps of the process.
Figure 5:
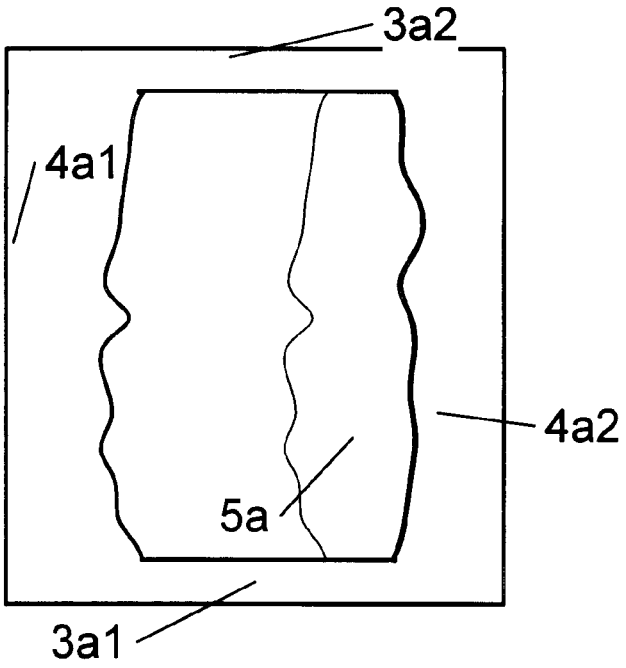

The cavity can have any form or shape, as long as it complies with the above. For example, rounded corners on the piston wall and cavity might be an option. Furthermore, there is nothing to prevent combining several different cavity-forms and embodiments of the same pump unit as long as each individual pump element has the same stroke and the same vertical range. FIG. 4 shows an embodiment of the pump unit in a first process step where the piston wall 5A is closer to the left inner limit surface than the right and FIG. 5 shows the same embodiment in a second process step where the piston wall is closer to the right inner limit surface than the left.

It should also be noted that even if, in the described embodiments, either the inner side wall or the outer side wall in a certain direction, is sealing the cavity, and either the framebottom or bottom element seals the cavity, this doesn't have to be the case. The inner part and the outer part can in combination seal the cavity. In other words, if a inner side wall is missing within an area, at a certain (z,y)-position, the outer wall adjacent to this wall should seal this area instead, and if the Framebottom, within an area, is missing somewhere, the bottom element is to cover this surface, unless it is an opening that is supposed to expose a connection on the outer part.

In summary, if the outer part 16 comprises a bottom element, the pump unit will comprise a cavity delimited by:

a. a first side wall 4*a*1 on the inner part and/or a first outer sidewall 4*ua* 1 on the outer part;
b. a second side wall 4*a*2 on the inner part and/or a second outer sidewall 4*ua*2 on the outer part;
c. a first 3*a*1 and a second end stops 3*a*2;
d. a bottom element 12 on the outer part and/or a frame bottom 13*a* on the inner part;
e. and a static bottom element 18, the inner and outer side walls, frame bottom and end stops being sealingly disposed between the bottom element and 12 top element and that the inner sidewalls and end stops are slidably disposed on the bottom element 12;

To the top element is attached a piston wall 5*a* slidingly disposed in the cavity and ranging from the first to the second end stop, where a driving means drives the top element to perform a rotating movement and where into the cavity is connected at least one primary inlet 6 with an inlet opening 6*x* and at least one primary outlet 9 with an outlet opening 9*x* where during the scrolling movement at least one of the inner sidewalls, end stops, frame bottom seal or open ports 6*x*, 9*x* in such a way that a pumping effect from primary inlet to the primary outlet is achieved;

There may also be at least one secondary inlet 8 with an inlet opening 9*y* and at least one secondary outlet 7 with an outlet opening 7*x* connected to the cavity, in which case during the scrolling movement at least either of the sidewalls, stops, frame bottom seal and open ports 9*y*, 7*x* in such a way that a pumping effect from secondary inlet to the secondary outlet is achieved.

Embodiments in which the outer part comprises a bottom element include at least the following alternative combinations:

The side walls 4*a*1,4*a*2 and end stops 3*a*1,3*a*2 are fixedly connected together and are jointly slidably provided on the bottom element 12. The outer side walls 4*ua*1,4*ua*2 and frame bottom are missing.

The side walls 4*a*1,4*a*2 and end stops 3*a*1,3*a*2 and frame bottom 13*a* are rigidly connected together and are jointly slidably provided on the bottom element 12. The outer side walls 4*ua*1,4*ua*2 are missing.

The end stops 3*a*1,3*a*2 are rigidly connected to one another but slidably disposed in the space between the outer side walls 4*ua*1,4*ua*2, while the outer side walls is fixedly connected to the bottom member 12. The side walls 4*a*1,4*a*2 and frame bottom are missing.

The end stops 3*a*1,3*a*2 and frame bottom 13*a* is fixedly connected to one another but slidably disposed in the space between the outer side walls, while the outer side walls 4*ua*1, 4*ua*2 is fixedly connected to the bottom element 12. The side walls 4*a*1, 4*a*2 are missing.

The end stops 3*a*1-2 and exactly one of the side walls 4*a*1,4*a*2 are rigidly connected to one another but slidably disposed along one of the outer side walls 4*ua*1, 4*ua*2 fixedly connected to the bottom member 12. One of the outer side walls 4*ua*1,4*ua*2 and one of the side walls 4*a*1,4*a*2 and frame bottom missing.

The end stops 3*a*1, 3*a*2 frame bottom 13*a* and exactly one of the side walls 4*a*1,4*a*2 are rigidly connected to one another but slidably disposed along one of the outer side walls 4*ua*1,4*ua*2 fixedly connected to the bottom member 12. One of the outer side walls 4*ua*1, 4*ua*2 and one of the side walls 4*a*1,4*a*2 are missing.

The end stops 3*a*1-2 and exactly one of the side walls 4*a*1,4*a*2 are rigidly connected to one another but slidably disposed between the outer side walls 4*ua*1,4*ua*2 fixedly connected to the bottom element 12. The side wall 4*a*1,4*a*2 and frame bottom are missing.

The end stops 3*a*1,3*a*2, frame bottom 13*a* and exactly one of the side walls 4*a*1,4*a*2 are rigidly connected to one another but slidably disposed between the outer side walls 4*ua*1,4*ua*2 fixedly connected to the bottom element 12. The other side wall 4*a*1,4*a*2 is missing.

The side walls 4*a*1,4*a*2 and end stops 3*a*1,3*a*2 are rigidly connected to each other, but slidably arranged in the space between the outer side walls 4*ua*1,4*ua*2, alternatively, slidably disposed along one of the outer side walls 4*ua*1,4*ua*2, while the outer side walls is fixedly connected to the bottom element 12. The frame bottom is missing.

the side walls 4*a*1,4*a*2 and end stops 3*a*1,3*a*2, frame bottom 13*a* is fixedly connected to each other, but slidably arranged in the space between the outer side walls 4*ua*1,4*ua*2 alternatively slidable along one of the outer side walls 4*ua*1,4*ua*2. The outer side walls is fixedly connected to the bottom element 12.

Different wall-combinations in combination with different connection-position-combinations makes up for large number of different embodiments.

If the pump does not have a bottom element, the resulting unit will be a pump unit comprising a cavity delimited by a. a first outer sidewall 4*ua*1 in the outer part, possibly having a first side wall 4*a*1 in the inner part;

b. a second outer sidewall 4*ua*2 in the outer part, possibly with a second side wall 4*a*2 in the inner part;

c. a first 3*a*1 and a second end stops 3*a*2 in the inner part;

d. a frame bottom 13*a* in the inner part, wherein the side walls, frame bottom and end stops are sealingly disposed toward the top element and the end stops and the side walls are slidably disposed between the outer side walls. A piston wall 5*a* is attached to the top element slidingly disposed in the cavity and ranging from the first to the second end stop. A drive means drives the top element to perform a scrolling movement and the cavity is connected to at least one primary inlet 6 with an inlet opening 6*x* and at least one primary outlet 9 with an outlet opening 9*x* where during the scrolling movement the inner part covers or opens ports 6*x*, 9*x* in such a way that a pumping effect from primary inlet to the primary outlet is achieved;

To the outer part at least one secondary inlet 8 with an inlet opening 9*y* and at least one secondary outlet 7 with an outlet opening 7*x* may also be connected. In this case, during the rotating movement the inner part exposes or covers ports 6*x*, 9*x* in such a way that a pumping effect from secondary inlet to the secondary outlet is achieved.

Embodiments in which the outer part does not have a bottom element include at least the following:

side walls 4*a*1,4*a*2 end stops 3*a*1,3*a*2 and frame bottom 13*a* are fixedly connected to each other and slidably disposed in the space between the outer side walls 4*ua*1,4*ua*2.

the end stops 3*a*1,3*a*2, frame bottom 13*a* and exactly one of the side walls 4*a*1,4*a*2 are rigidly connected to each other and slidably disposed in the space between outer side walls 4*ua*1,4*ua*2.

Process

FIGS. 6*a*-6*f* illustrate the pumping work cycle in a pump according to a third embodiment of the invention. As the inner part in this embodiment has no side walls and no frame bottom, the cavity is limited instead by outer side walls 4*ua*1 and 4*ua*2, bottom element 12, and the end stops 3*a*2 and 3*a*1. The end stops are connected to each other and slide freely between the outer sidewalls 4*ua*1 and 4*ua*2, which are connected to the bottom element. Connection 6*x* sits beside outer sidewall 4*ua*1 close to the end stops 3*a*2 upper turn position. Connection 7*x* sits beside outer sidewall 4*ua*2 close to the end stops 3*a*2 upper turn position. Connection 9*x* sits beside the outer sidewall 4*ua*1 close to the end stops 3*a*1 lower turn position. Connection 9*y* sits beside outer sidewall 4*ua*2 close to the end stops 3*a*1 lower turn position.

In this embodiment, the end stops are used to expose or cover the connections 6*x*, 7*x*,9*x* and 9*y*. The top element scrolls and moves the end stops so that when they are in the upper end position connections 9*x* and 9*y* are covered while connections 6*x* and 7*x* are open so that when the piston moves from 6*x* to 7*x* fluid is sucked in through 6*x* at the same time as it is ejected through 7*x*. When the top element scrolls into the bottom position the upper end stop covers connections 6*x* and 7*x* at the same time as the passage between the piston wall pages 9*x* and 9*y* is open so that when the piston wall moves from 9*y* against 9*x* moved fluid from left to right in the image plane.

In the following description, it will be described as if the connections 6*x*, 7*x*, 9*x* and 9*y* is located on the bottom element but they can of course also sit on the outer side walls 4*ua*1 and 4*ua*2 (but at the same height). Pump components are, except for that, of the same basic design in both embodiments.

Figure 6A:
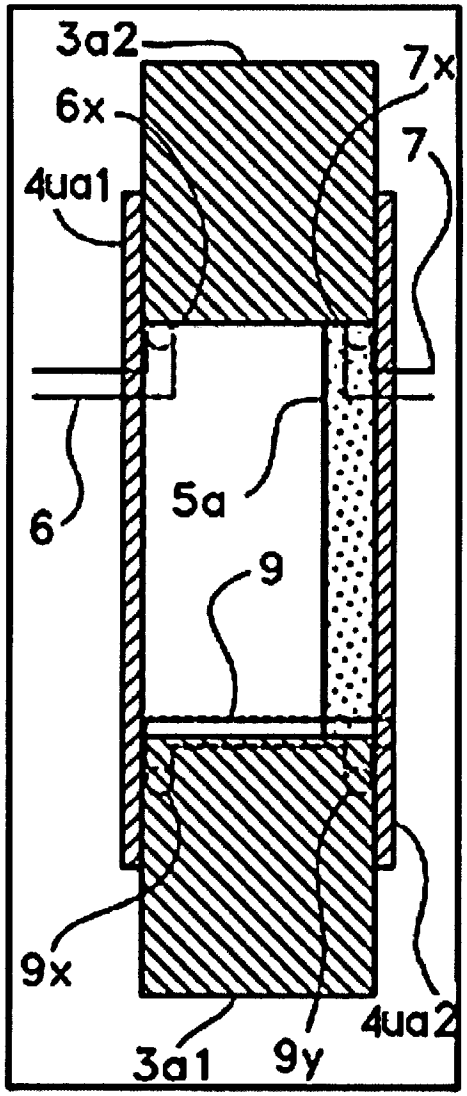
FIG. 6*a*-6*f* illustrate a working cycle of a pump according to an embodiment of the invention.

FIG. 6*a* shows in detail the third embodiment of the pump unit including a pump element, in a first processing step.

Between the mainly fixed side walls are two vertically moving end stops 3*a*1,3*a*2 where the two end stops in each pump element are connected to each other. End stops can slide freely in the space between the sidewalls and during the movement against the bottom element. Because they are connected to each other, although this is not illustrated in the figure, the movement of one end stop in a pump unit forces the other end stop to move in the same way. The end stops in each pump unit are arranged with a space between them, so the two outer side walls and the two end stops in conjunction with the bottom element defines a cavity. This cavity can then be shifted back and forth depending on the end stops motion, shown in the figure plane as up and down. This cavity formed in each pump element is divided into two chambers by a piston wall 5*a* extending between the two end stops, in parallel with the sidewalls. The piston is connected to a top element placed on top of the end stops and the outer side walls of the cavity. The top element closes the hitherto open space and forms the closed space in which the pumping occurs. By moving the top element, the piston moves in a corresponding manner.

The piston extends all the way between two interconnected end stops and since these only can move up and down (with reference to the Figure) the piston wall's motion components extending in parallel with the direction in which the end stops can move, will be followed by the end stops. The top plate is driven by a drive mechanism to perform a scrolling movement which then causes the piston to make a corresponding movement and forces the end stops to move up and down.

To the space is connected an inlet 6 which flow into a left-hand upper connection 6*x* in the bottom element. This left-hand upper connection is arranged in the compartment beside the left outer sidewall underneath the upper end stops in its top position. To the cavity is connected an upper outlet 7, which opens in a right-hand top connection 7*x* in the bottom element. This right-hand upper connection 7*x* is arranged in the compartment beside the right outer sidewall underneath the upper end stop in its top position. To the cavity is connected a left-hand lower connection 9*x* and a right-hand lower connection 9*y*, where these connections 9*x*,9*y* are connected to each other via an internal cross connection 9. These connections 9*x*9,*y* are disposed in the compartment beside the left 9*x* and right 9*y* outer sidewall near the lower end stop's lowest position.

When the top plate scrolls it makes the piston move the end stops so that they will expose or cover the various connections. This process is described here as a 5 step process with reference to the figures shown in FIG. 6*a* to FIG. 6*f*.

In FIG. 6*a* the piston 5*a* is in its rightmost position beside the right outer sidewall 4*a*2, and close to its top position. In this position, the piston blocks the upper right connection 7*x*. The lower end stop 3*a*1 blocks the lower connections 9*x*,9*y*. The only connection not blocked is the upper left 6*x* connected to the inlet 6. The top element moves clockwise and thus the piston in the same way, so fluid is sucked into the left half from the inlet 6 via the upper left connection 6*x*.

Figure 6B:
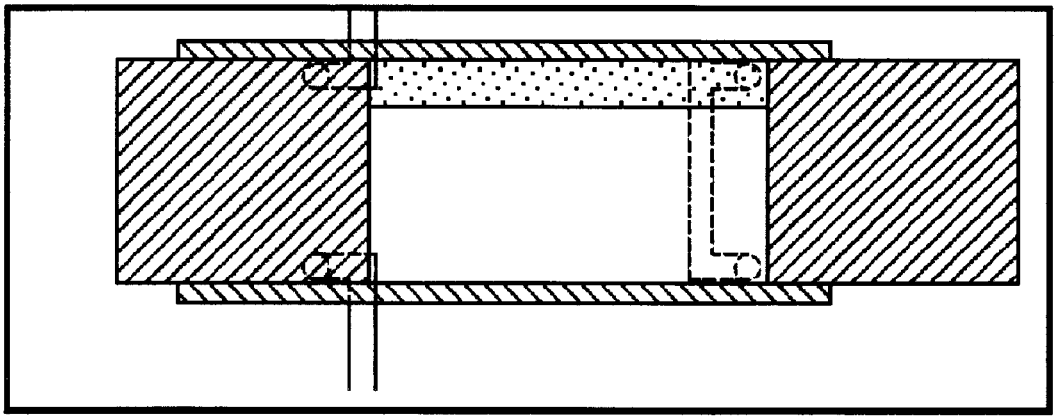

FIG. 6*b* shows a second process step where the piston 5*a* is in its rightmost position beside the right outer sidewall 4*ua*2, but here close to its lowest position. The upper end stop here blocks the two upper connections 6*x*, 7*x*, while the piston blocks the lower right connection 9*y*. The only outlet port that is not blocked is the lower left 9*x* connection.

Figure 6C:
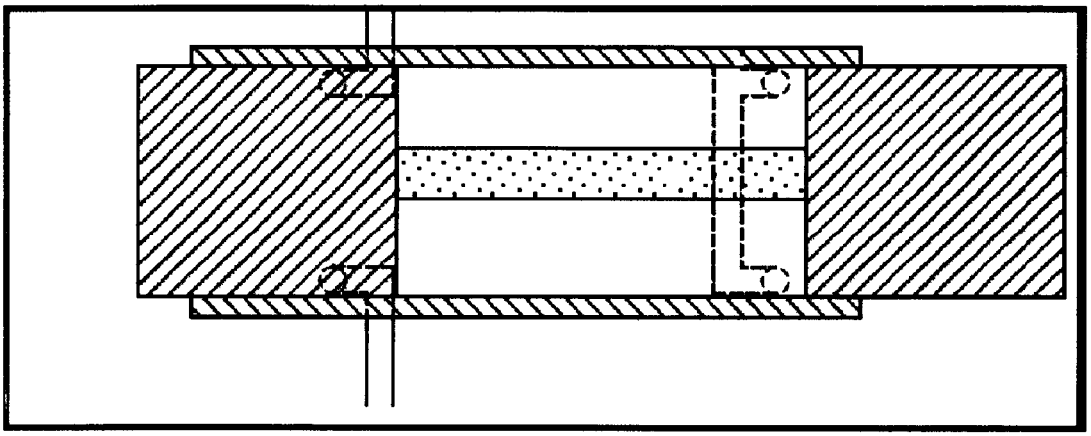

FIG. 6*c* shows a third process step where the piston 5*a* is in a central location between the right-hand and left-hand side walls, but here in its lowest position. The upper end stop still blocking the two upper connections 6*x*, 7*x*, while the two lower connections 9*x*,9*y* are not blocked. This will allow the fluid to pass from the piston wall left side to the right-hand side via the internal cross-connection 9.

Figure 6D:
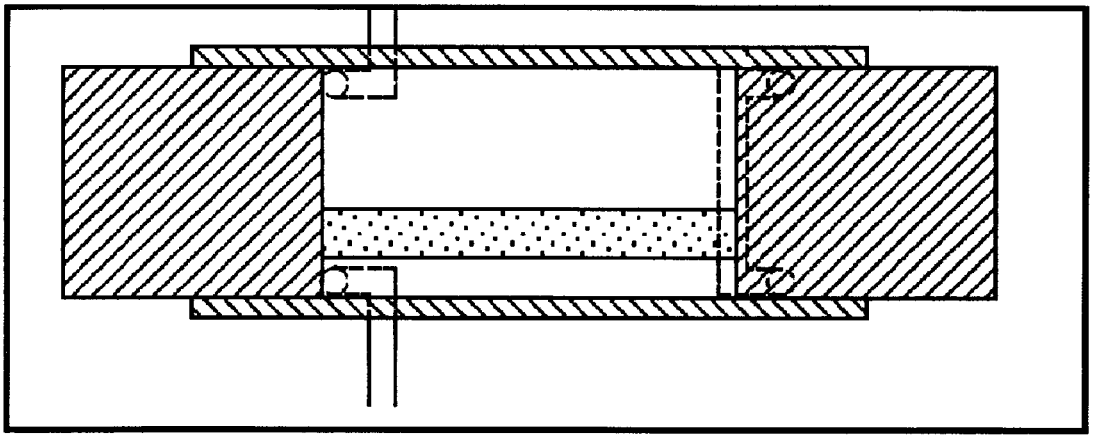

FIG. 6*d* shows a fourth process step where the piston 5*a* is moved almost to its leftmost position and is close to the left outer sidewall 4*a*1. The upper end stop still blocks the two upper connections 6*x*, 7*x*, and the lower end stop almost blocks the two lower connections 9*x*, 9*y*.

Figure 6E:
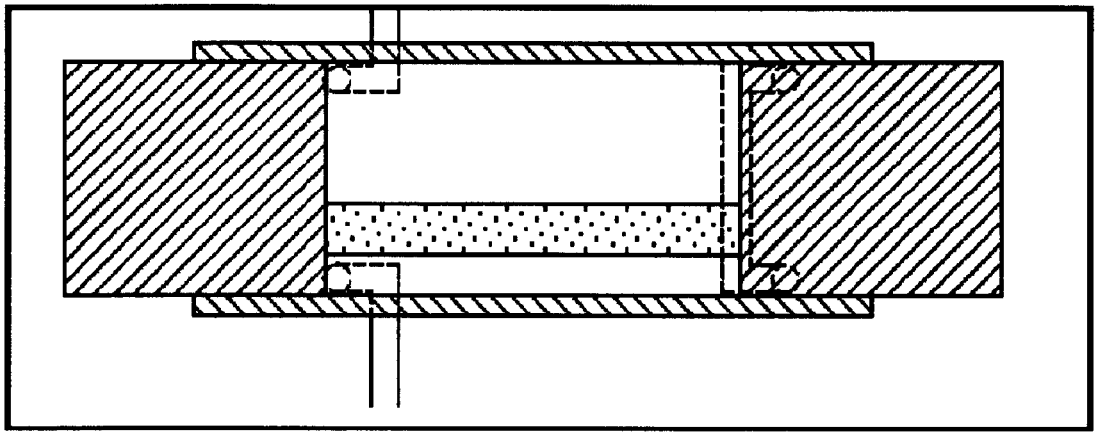

FIG. 6*e* shows a fifth process step where the piston 5*a* traveled to the right from its leftmost position beside the left outer sidewall 4*ua*1, as well as moved a distance up from the vertical center position. The lower end stop blocks the two lower connections, while the upper connections are exposed. The piston wall's movement to the right then pulls the fluid through the inlet 6 to the cavity's left-hand side and forces the fluid from the cavity's right-hand side out through the upper outlet 7.

Figure 6F:
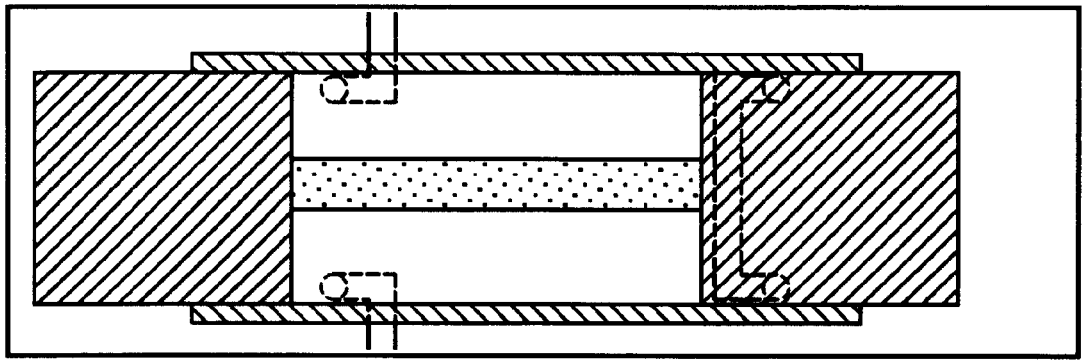

FIG. 6*f* shows a sixth process step where the piston 5*a* has been moved further to the right and up to its top position. The lower connections are blocked in the same manner as in FIG. 6*e* so fluid is drawn in through the upper inlet and out through the upper outlet. In the next process step is reached the stage as illustrated in FIG. 6*a* and one cycle is accomplished. This cycle gives a pump effect without any valves that must be opened or closed is the outlet openings, it automatically opens and blocks the connections by the end stops and piston wall movements.

A pump element may designed in such a way that several pump elements can be powered by a single drive mechanism. Similar pump cycles may then be achieved in more than one pump unit by only the rotating movement of one top element, having two pistons.

Figure 7A:
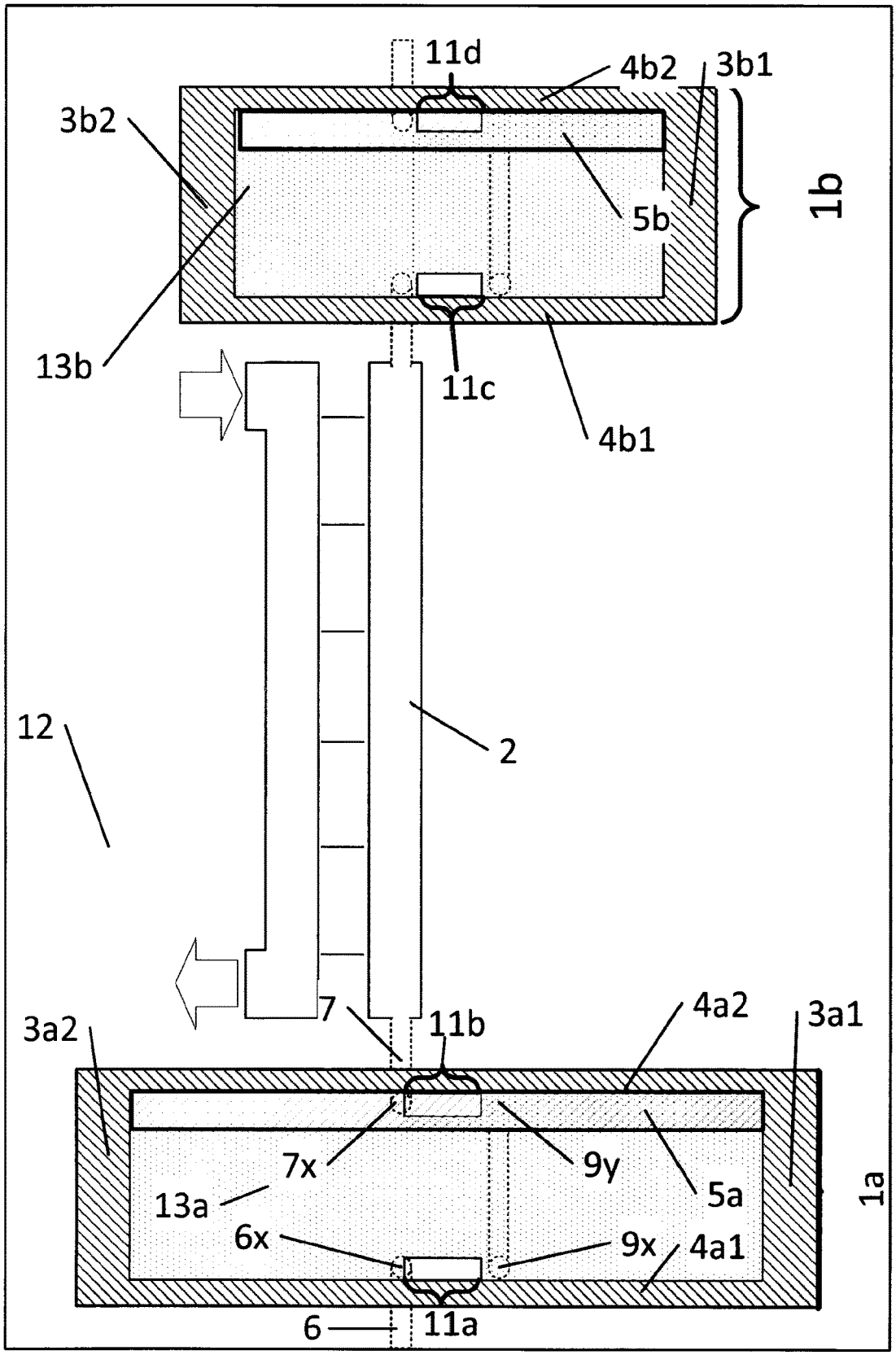
FIG. 7*a*-7*f* show an embodiment of a pump units used in conjunction with a heat exchanger, at different stages of a working cycle.

Pump elements according to the invention are particularly suitable to be used in conjunction with a heat exchanger, as shown in FIGS. 7*a*-7*f*. FIG. 7*a* shows in detail a pump unit comprising two pumps according to an embodiment of the invention in a first processing step. The pump unit includes two identical pump element 1*a*, 1*b*, connected to each other via a heat-exchanger 2, where the outlet from the first pump unit is connected to the heat exchanger primary inlet and the inlet to the second pump unit is connected to the primary outlet from the heat exchanger. The heat exchanger has a secondary inlet and outlet of the fluid from which heat is taken or to which the heat emitted by the heat exchanger. The purpose of the heat exchanger in conjunction with pump elements is not the main object of this invention, so this is described here only briefly.

Because they are functionally identical and operates in such a way that they move synchronously, only a pumping element will be described in detail, but that described for one pump unit also applies to the other. Pump units comprising any combination of side walls, outer side walls, bottom element and/or frame bottom as discussed above, may be used.

In FIGS. 7*a*-7*f*, each pump element 1*a* comprises two mainly parallel side walls 4*a*1,4*a*2, arranged on a frame bottom. They are at the same time connected with two further end stops 3*a*1,3*a*2, also these walls are connected to the frame bottom. Together said parts form a cavity that can be likened to a sealed cavity.

The outer part has a bottom element illustrated symbolically as a rectangle surrounding the whole pump unit, on which the frame bottom rests. The upper and lower walls in each cavity is arranged with a gap between the end stops, so the two side walls and the two stops in conjunction with frame bottom defines a cavity open opposite to the bottom.

This cavity can only be moved vertically in the figure plane, that is, parallel to the extension of the side walls.

The frame bottom is controlled to slide freely back and forth relative to the outer part, and is constantly in contact with the bottom element. All previously described cavities are connected to each other and therefore move identically.

The cavity upper edge (outwards) is smooth, i.e. it has the same height above the plane of the figure. It is freely, sealingly connected to a top element located on top of the cavity. With the top plate the cavity forms a closed space in which the pumping occurs.

At the top element is attached a piston wall 5*a*1 slidingly disposed in the cavity. The piston extends all the way between two interconnected end stops. The piston should be such designed so that it can, with ease slide, laterally in the cavity. This from the left end to right end and back. At the same time, it will be so tightly sealed that no fluid can slide on the side of the piston.

By moving the top element, the piston moves in the same way. The piston extends all the way between two interconnected end stops and since it can only move vertically, the movement of the piston wall components extending parallel to the direction in which the cavity can move, it will be followed by the cavity. Relatively to the cavity the top plate with piston wall will however just move sideways.

To the cavity is connected an inlet 6 which flow into a left-hand upper opening 6*x* in the bottom element. To the cavity is connected an upper outlet 7, which results in a right-hand top opening 7*x* in the bottom element.

The pump unit is connected to the bottom element outlet 8 which is connected to the two connections 9*x*,9*y* in the bottom element, a left-hand lower connection 9*x* and a right lower connection 9*y*, where these openings 9*x*, 9*y* are connected to each other via an internal cross connection 9. These connections 9*x*, 9*y* are disposed in the pump unit beside the left 9*x* and right 9*y* sidewall.

When the top plate causes the piston to scroll and thus moving the cavity, up or down, the openings in the frame bottom will either expose the connections in the bottom element and make the flow through equaled connections possible, or they will cover the connection, which is then blocked.

For example: if the top plate scrolls clockwise and starts to go up in an upper position, it moves up the cavity so that the hole 11*a* coincides with 6*x* and hole 7*y* 11*b* coincides with 7*x*. Since the top plate scrolls clockwise the piston will move to the right, relative to the cavity, and thus sucking fluid via line 6, at the same time as the fluid is ejected from the cavity via line 7.

If the top plate continues to turn clockwise and starts to go down in a lower position and moves down the cavity so that the hole 11*a* coincides with 9*x* and hole 11*b* coincides with 9*y*. Since the top plate scrolls clockwise the piston will also start to move to the left and thus to eject the fluid via line 9*x*, from left to right side of the piston, since 9*x* and 9*y* is short-circuited.

Figure 7B:
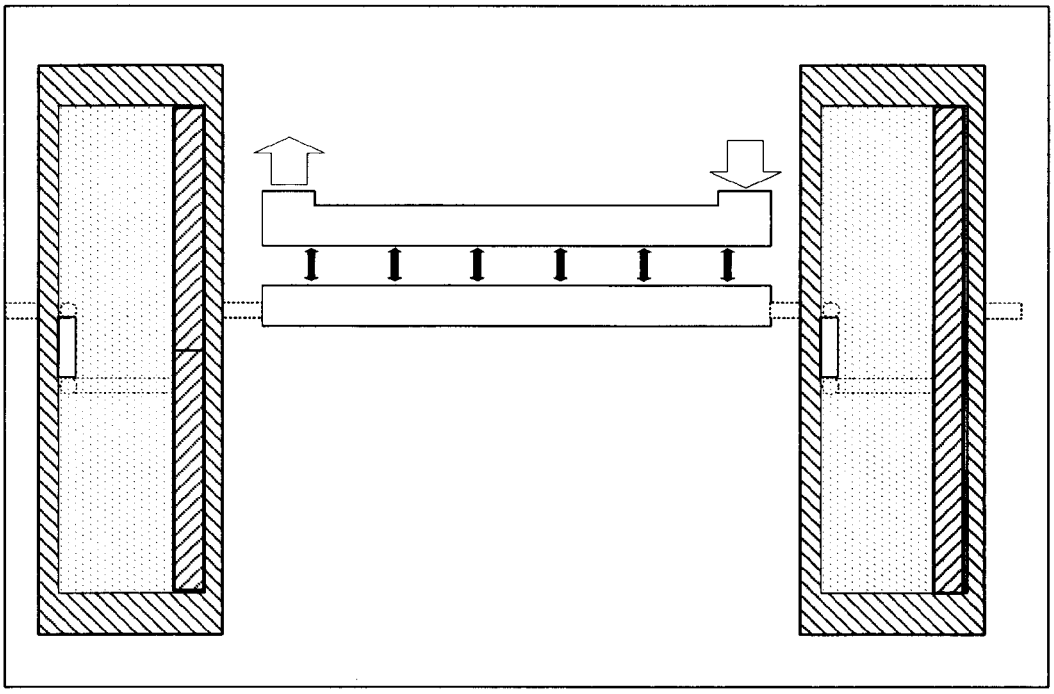
Figure 7C:
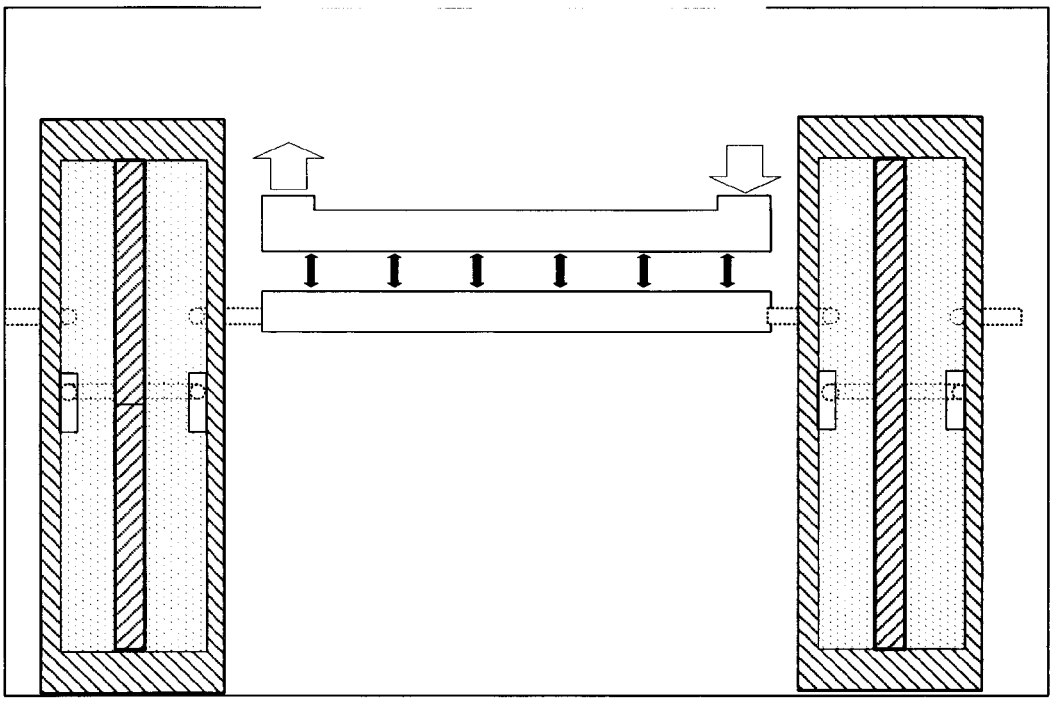
Figure 7D:
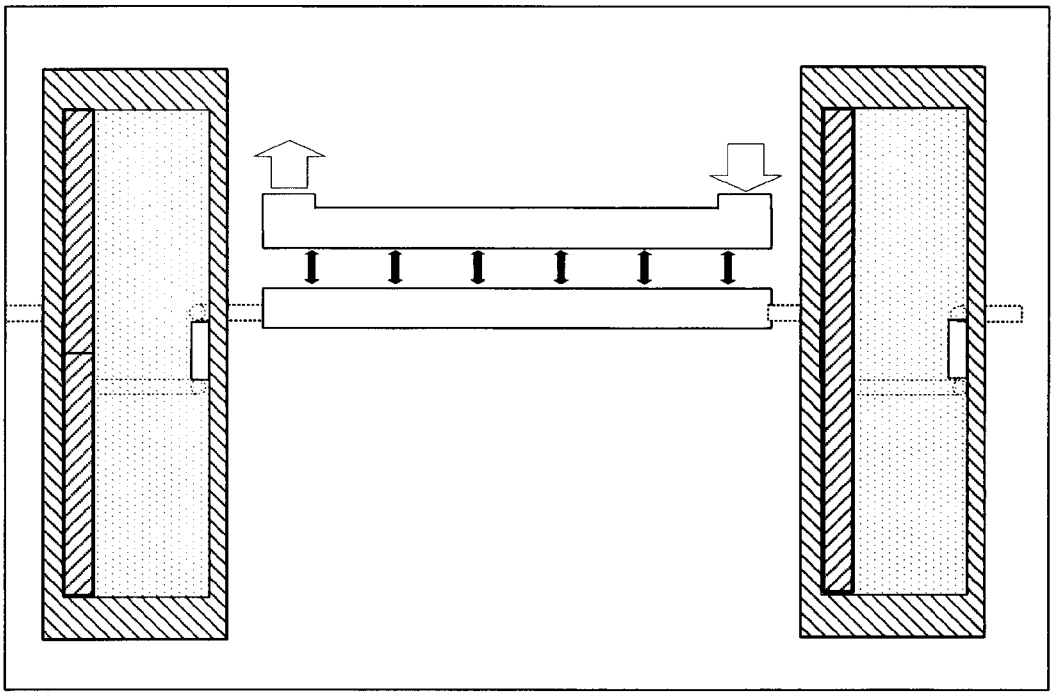
Figure 7E:
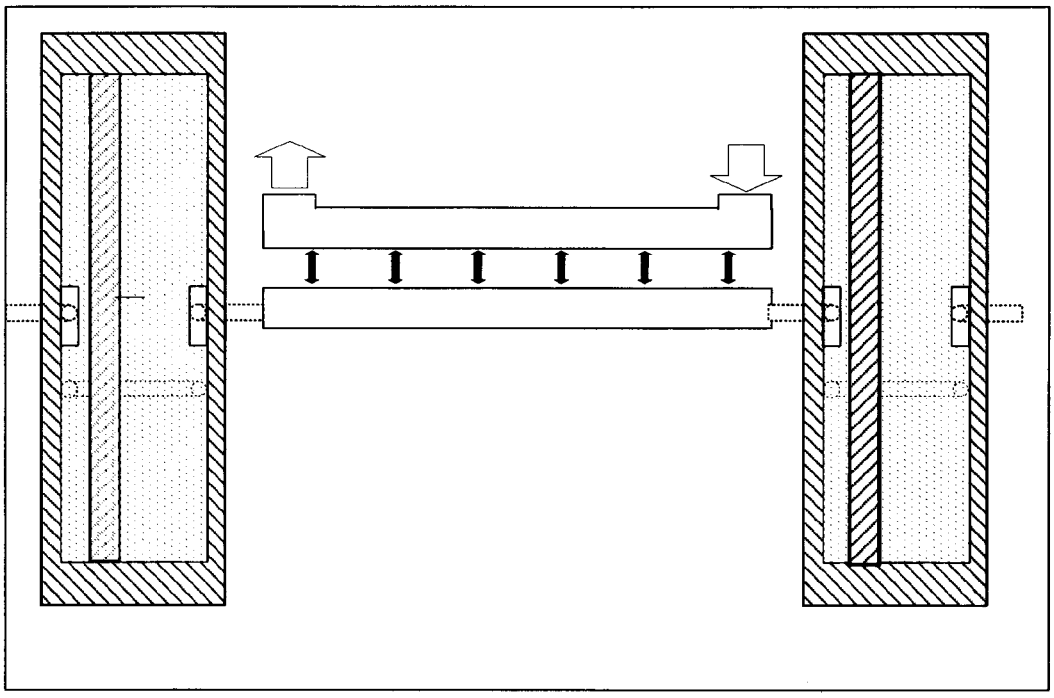

In FIG. 7*b* is the piston 5*a*, 5*b* in its rightmost position beside the right side wall 4*a*2, and in its middle vertical position. In this position, the piston blocks the right-hand connections 7*x*,9*y* and the frame bottom blocks all connections 6*x*,9*x*,7*x*,9*y*. FIG. 7*c* shows a third process step where the piston 5*a* is in a central location between the right-hand and left-hand side walls, but here in its lowest position. The frame bottom still blocks the two upper connections 6*x*, 7*x*, while the two lower connections 9*x*, 9*y* are exposed by the openings 11*a* and 11*b* respectively. This will allow the fluid to pass from the piston wall left side to the right-hand via the internal cross-connection 9. FIG. 7*d* shows a fourth process step of the first embodiment where the piston 5*a* is in its leftmost position beside the left sidewall 4*a*1. The opening 11*a* is now between 6*x* and 9*x* and 11*b* between 7*x* and 9*y*, so there is no connection in or out of the cavity. The frame bottom then blocks the connections 6*x*, 7*x*, 9*x* and 9*y*. Also, at this stage the piston wall 5*a* blocks the lower left-hand outlet openings 6*x* and 9*x*. FIG. 7*e* shows a fifth process step of the first embodiment where the piston 5*a* traveled to the right from its leftmost position (beside the left sidewall 4*a*1) as well as moved slightly up from the previous position. The frame bottom blocks the two lower connections, while the two upper connections are in contact with the frame bottom's openings and thus are not blocked. The piston wall motion to the right then sucks the fluid through the inlet 6 into the cavity left half and forces the fluid from the cavity's right half out through the upper outlet 7.

Figure 7F:
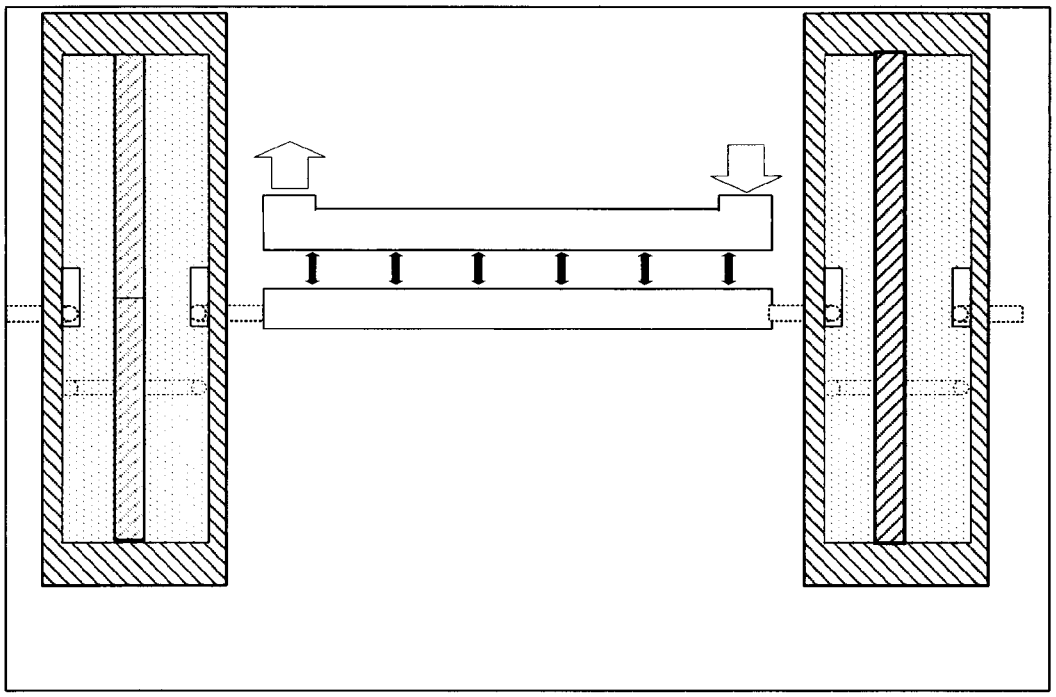

FIG. 7*f* shows a sixth process step where the piston 5*a* moved further to the right and up to its top position. The lower connections are still blocked and the upper connected to the frame bottoms openings, in the same manner as in the previous figure, so fluid is drawn in through the upper inlet and out through the upper outlet. In the next process step is reached the stage as illustrated in FIG. 1 and then one cycle is accomplished.

This cycle then gives a pumping effect without any valves that must be opened or closed. The connections are automatically exposed/blocked by frame bottoms and the piston walls own movements. The same pump cycle is accomplished in both pump units by only the rotating movement of the top plate.

The pump elements are also particularly suitable to be used as a compressor. A device of at least two pump elements, possibly with a common scrolling top element, may be designed such that the cavity volume, in the gas flow direction, becomes smaller or larger so that the device can be used as a compressor or an expander respectively.

The invention makes it possible to achieve a large flow with low friction with small movements, both vertical and lateral, in a pump unit in which each individual cavity has really small volume but inlet 6 directly connected to inputs 6*xa*, 6*xb* . . . on a number of elements and also outputs 9*xa*, 9*xb* . . . directly connected to a common outlet 9. These outputs can then be connected to the new collection of cavities, linked in a similar way.

In this way, a compressor may be constructed. If each individual cavity now has a very small volume, relative to the total, it is not necessary to have cavities of different volumes. A first series of interconnected cavities can constitute a first volume and a second series of interconnected cavities can constitute a second volume. Connecting the outputs from the first volume (for example, composed of 6 cavities) to the inputs of the second volume (for example, including 3 cavities), a compression of 6/3=2 is achieved. If a device comprises 100 cavities it can of course give more granular compression ratios, so in addition there are obvious advantages to have detailed cavities with different volume in order to achieve even more finely divided compression ratio.

Connecting any form of control device to the pump unit, controlling the connecting of selected input to the selected output, results in a dynamic compressor assembly, which continuously can set the compression ratio of the compressor without changing the design, simply by short-circuiting selected inputs and outputs. This may be achieved with only 2 moving parts (inner part and top element) in the compressor.

The pump elements are thus suitable to be used as a compressor with dynamic compression ratio. Using a device comprising several devices according to above, with a common scrolling top element, wherein the common outlet from a number of pump units having a specific total volume, is engaged in the inlet to a number of pump units, also shorted, resulting in another total volume, compression/expansion may be achieved by choosing which pump units to be connected with each other. The compression ratio may be controlled dynamically by means of some sort of PLC (Programmable Logic Controller), or similar, that dynamically controls which inputs 6*x*,9*y* and outputs 9*x*,7*x* that should be connected to each other, without changing the compressors movement and without adding other moving parts. Connecting a first pump to a second pump via a cooling heat exchanger will produce a cooled compressor.

Figure 8:
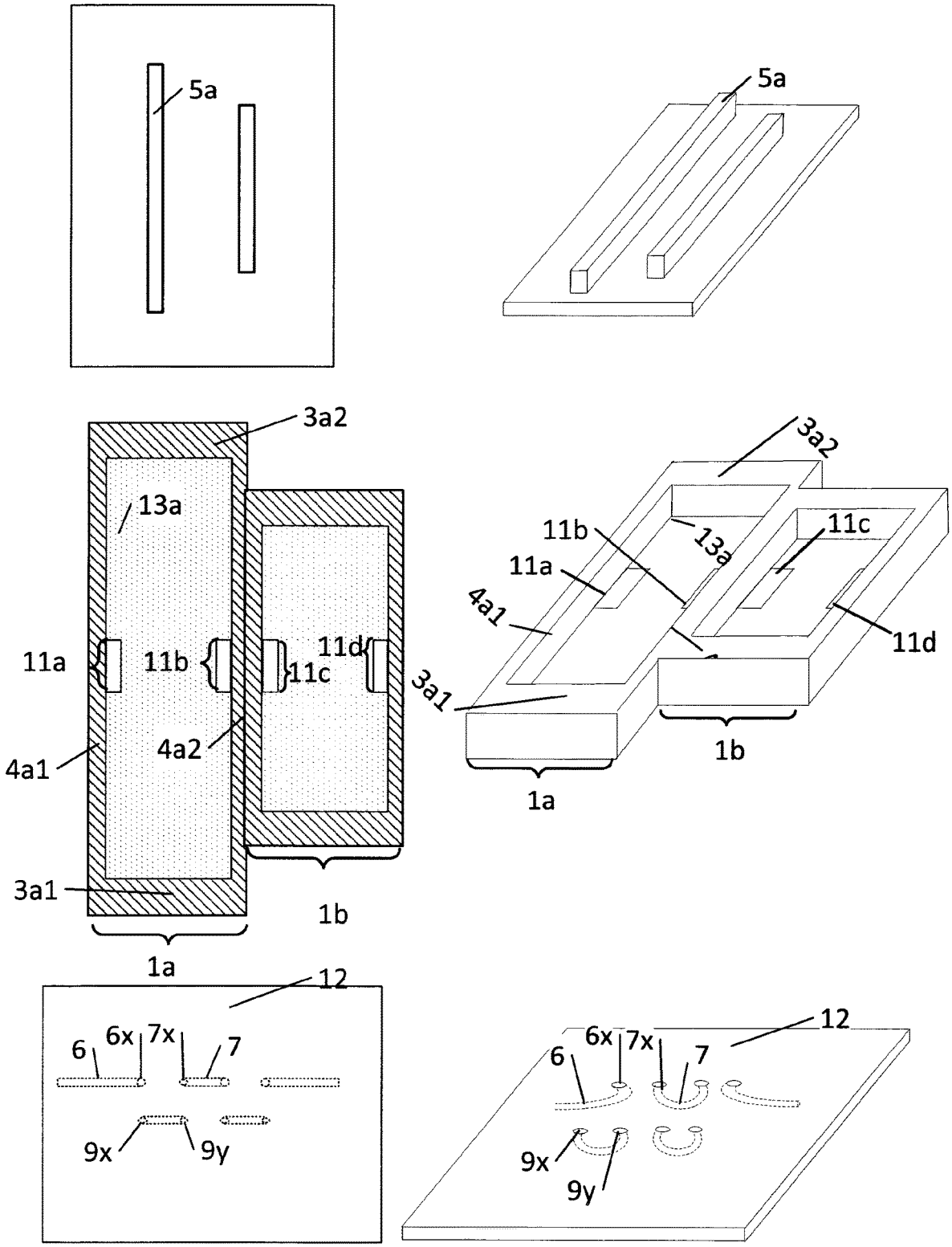
FIG. 8 shows an embodiment in which two pump units are connected to form a compressor.
Figure 9A:
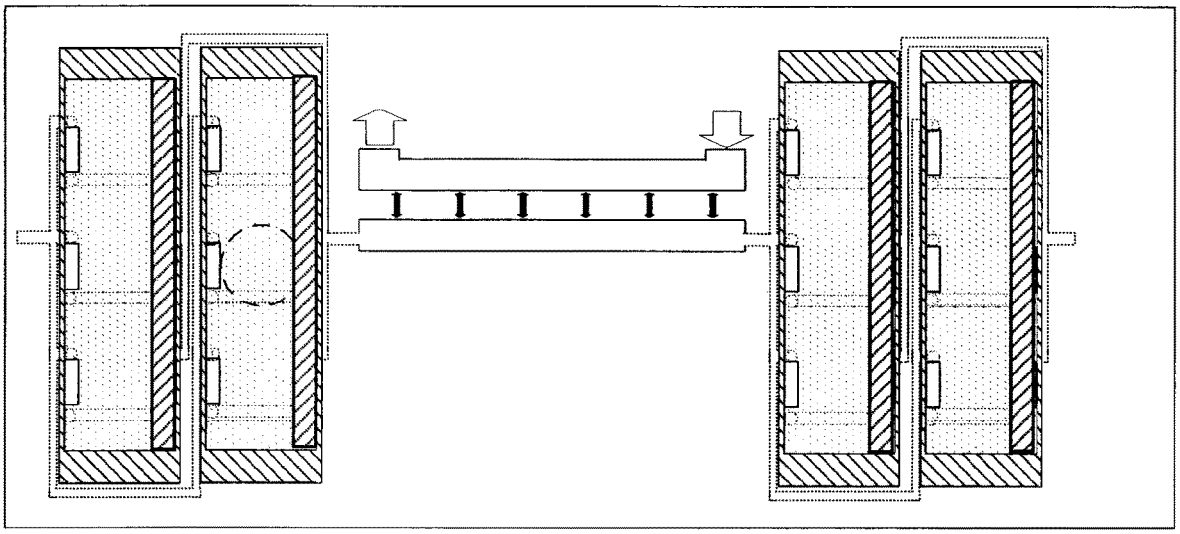
FIGS. 9*a*-9*d* illustrate how the pumping of large amounts of fluid may be facilitated.
Figure 9B:
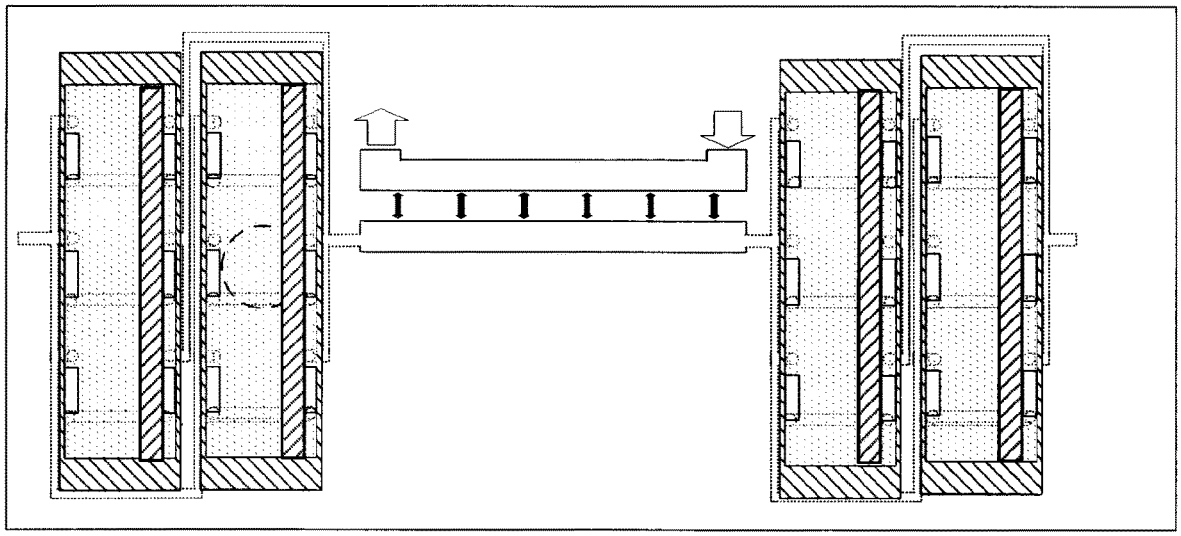
Figure 9C:
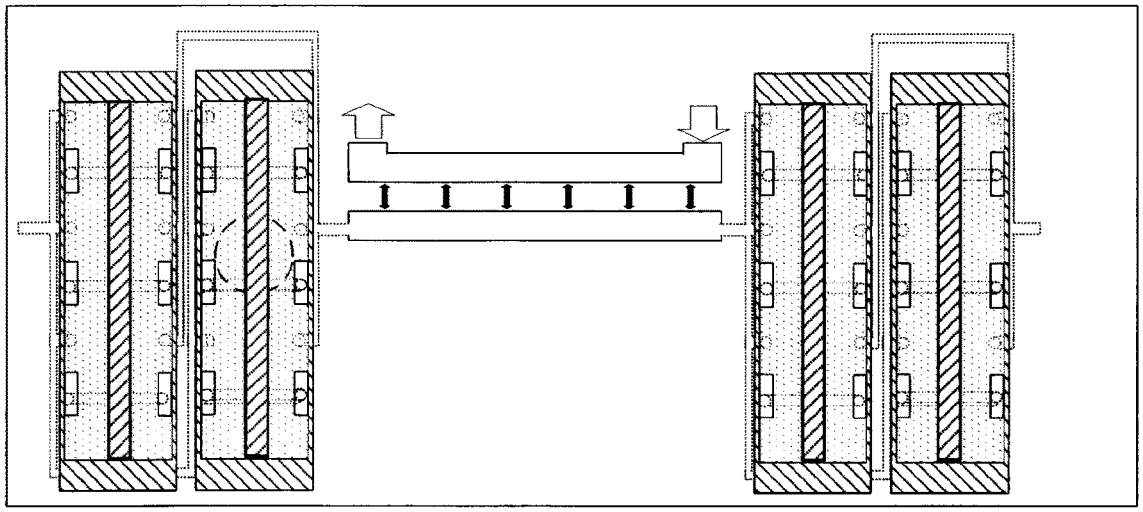
Figure 9D:
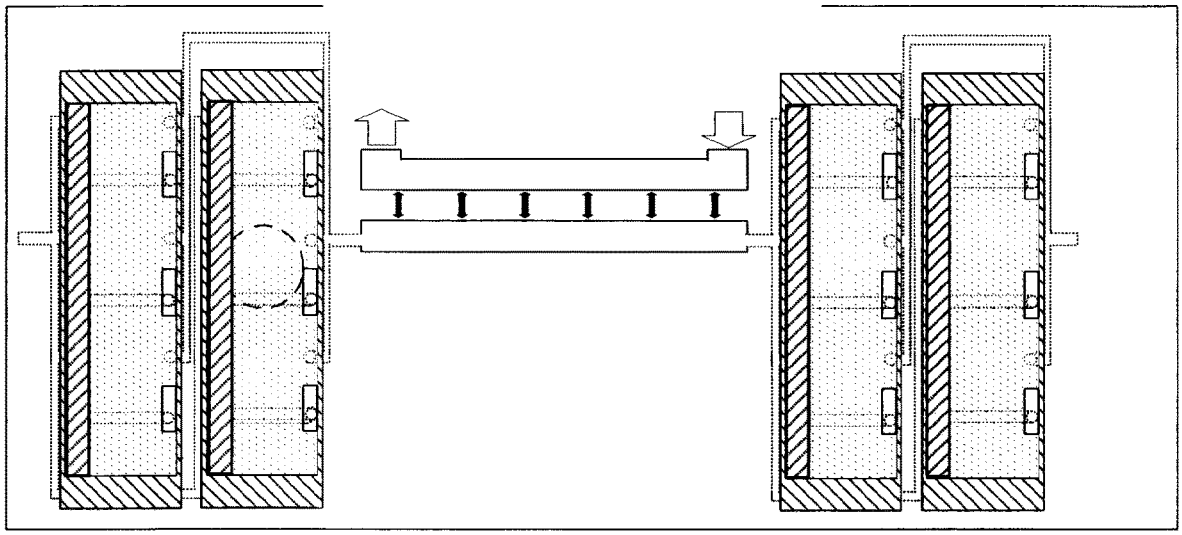

In some cases, it might be preferred to achieve significant pump power with small lateral movement. It may be achieved by linking the inlets of several pumping units (with the same stroke length) and linking the outlets of the same pump units. Then the same lateral motion will cause a greater fluid movement. In detail, this means that the input 6*x* from a pump unit is connected to the inputs 6*x* of one or more other units, while the outlets 7*x* from the other units are combined. In FIG. 8, the inlets 6*x* of two pumping units are connected to each, and the outlet 9*x* or 7*x* from the same pumping units are also directly connected to each other, in order to achieve fluid movement corresponding to several pumping units volume. In this way, increased pump effect can be achieved with small pumping movement. The pumps may be of any kind discussed in this document, and as the skilled person will realize, it is possible to connect more than two pumps in this way.

To facilitate the pumping of large amounts of fluid relative to the size of the openings, a number of holes may be used at the inner part 16, for each input and output, respectively, with corresponding openings in the outer part 17. This option is illustrated in FIGS. 9*a*-9*d*. This will have the effect that even a slight movement of the top element in height means a total a large opening to the openings 6*x*, 7*x* or 9*x*, 9*y*.

Reference is also made to the illustrations FIG. 9*a* to FIG. 9*d* for greater understanding. As seen from FIG. 9*a*, which corresponds to a first process step, for such a solution together with FIG. 9*d*, even if the piston wall just moved one stroke the fluid moved corresponds to 2 cavities. In this way, multiple cavities may be connected, to provide a large flow with small stroke and small volume.

In all embodiments disclosed, the piston 5*a* may be the element to slide up and down to move the end stops 3*a*1, 3*a*1, but there are also other possibilities. The piston will cause unwanted friction between the piston and the end stops. Advantageously, an additional element may be connected to the top element, which does not need to maintain sealing, to push the end stops up and down, outside the cavity and may be on the outer side of the end stops, and on the point of contact between this element and end stops using any form of friction reducing action (such as ball bearings). For example a rotating wheel placed on the top element according to one embodiment relieves the piston, which therefore does not need to cause more friction against the stops than what is required to ensure the sealing. There may also be roller wheels connected to the inner part wi1-4, which are directed from this against the walls T1,T2 to serve as a track to control the inner part to move only in one dimension, so that when the inner part and these walls slides against each other should be no unnecessary friction occur.

Figure 10:
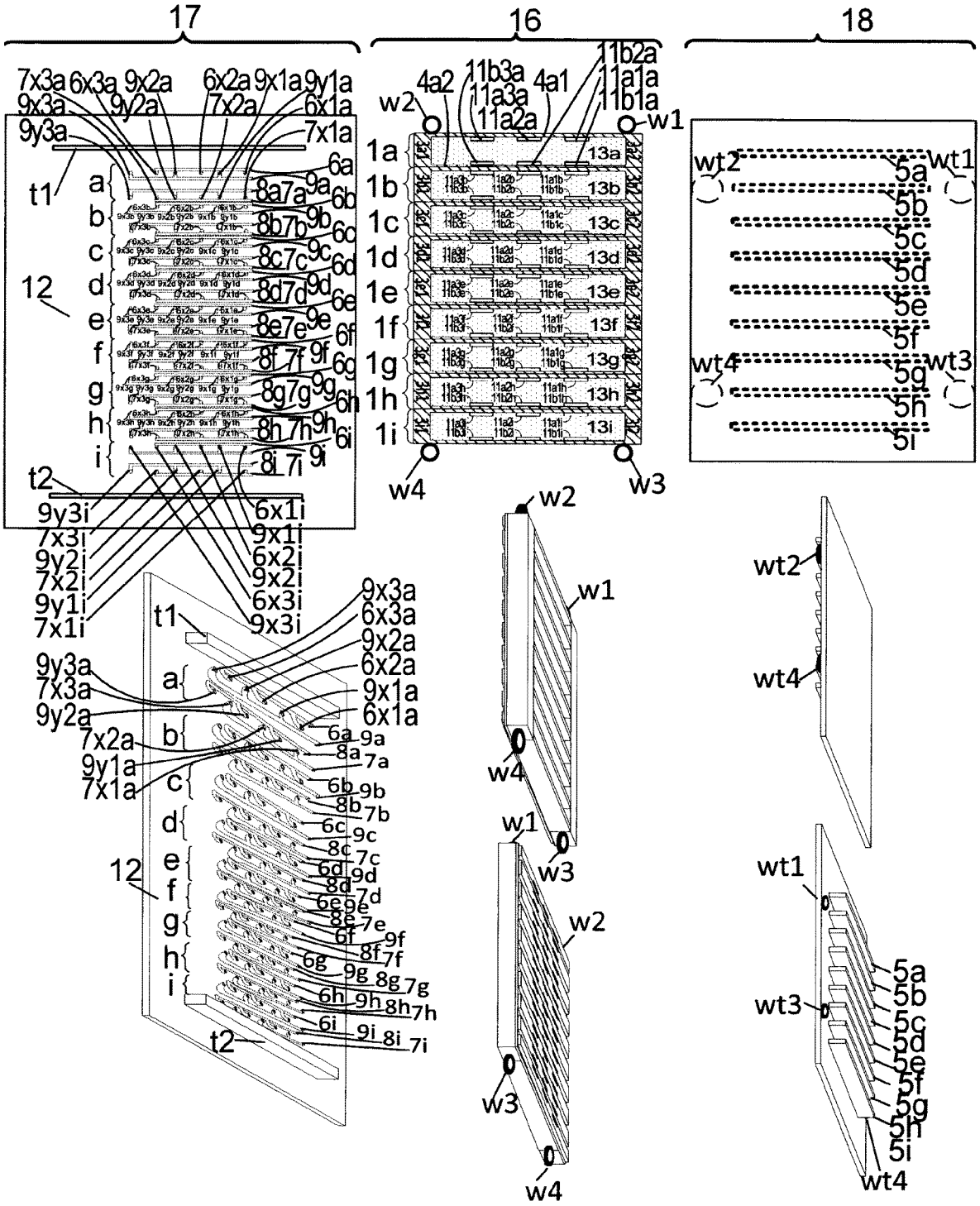
FIG. 10 shows an example of a pump unit in which several cavities are connected all of same volume, connected via a controlled connecting device, which on demand can short-circuit different cavities and can connect these cavities to other short-circuit devises and thus can act as either a compressor or expander, with the compression ratio controlled by the controlled connecting device.
Figure 11:
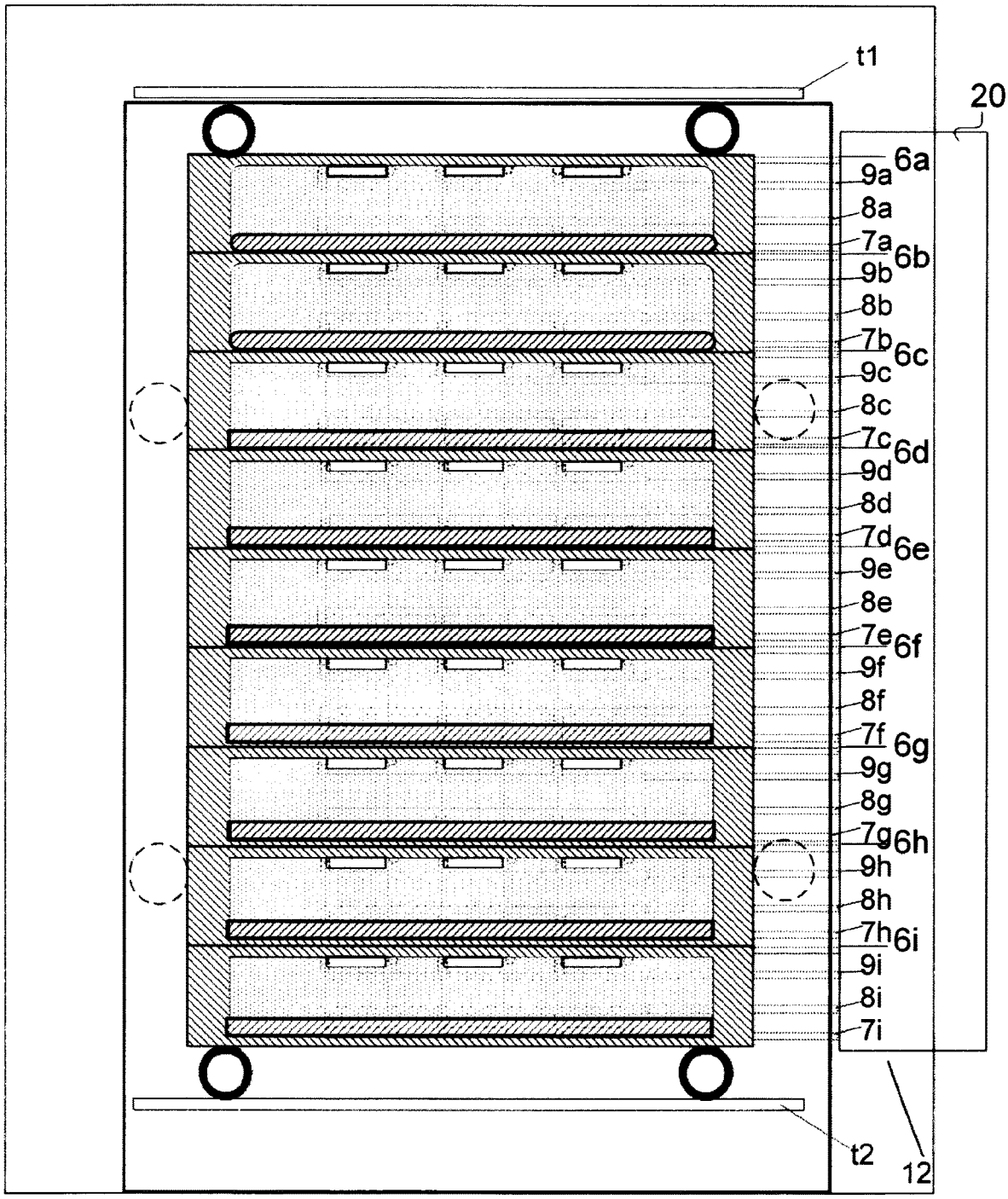
FIG. 11 shows a top view of the embodiment of FIG. 10.

The friction between the inner and outer parts friction may be reduced if skids, or distance elements are arranged on the inner part to slide against the bottom element 12. This is shown in FIG. 10, but may also be applied in all other embodiments including both a frame bottom and a bottom element. The skids may alternatively be placed on the outer part instead.

A fifth embodiment is illustrated in FIG. 10. It acts as the first embodiment in that the top element moves a cavity, where the inner part has endstops and wide walls and a frame bottom, the cavity being controlled to just go up and down. In addition to this, a driving means other than the piston may be used to move the inner part, for example this may be mainly performed by the contact surface of the wheel (WT1-4). In addition to this, there is also the wheel that contact between the inner part and outer part to reduce the friction.

As in the first embodiment the connections on the bottom element (12) are exposed by the openings on the frame bottom (13). Unlike in the first embodiment each separate inlet and outlet (6,7,9,8) is connected against three connections each.

On the left side of the cavity flow 6 is connected to the connections 6*x*1, 6*x*2,6*x*3, flow 9 is connected to the connections 9*x*1, 9*x*2, 9*x*3, three openings are placed on the Frame bottom (11*a*1, 11*a*2,11*a*3). They toggle between uncovering either the connections 6*x*1-3 or 9*x*1-3. 11*a*1 i.e. switches between 6*x*1 and 9*x*1, 11*a*2 between 6*x*2 and 9*x*2, 11A3 between 6*x*3 and 9*x*3. On the right side of the cavity is flow 8 is connected to the connections 9*y*1, 9*y*2,9*y*3 and flow 7 is connected to the connections 7*x*1, 7*x*2, 7*x*3. Three openings are placed on the Frame bottom (11*b*1, 11*b*2, 11*b*3)). They toggle between uncovering either the connections 7*x*1-3 or 9Y1-3. 11*b*1 i.e. switches between 7*x*1 and 9*y*1, 11*b*2 between 7*x*2 and 9*y*2, 11*b*3 between 7*x*3 and 9Y3.

Each collection of directly connected connections is corresponding to the openings on the Frame bottom. All connections 6*x*1-3 will i.e. be either exposed or covered at the same time, all connections 9*x*1-3 will be either exposed or covered at the same time, all connections 9*y*1-3 will either be exposed or covered at the same time and all connections 7*x*1-3 will be either exposed or covered at the same time. Thus, three connections instead of one are exposed at every occasion and a smaller movement is required to create a large opening.

In addition to this the embodiment shows how to make a further improvement in which in addition to linking multiple connections to the same flow, the unit can short-circuit several flows. In FIG. 10, the different pump elements has been renamed to a, b, c, d, e, f, g, h, i. If for example short-circuit all the flows 6(*a* to *i*) and all flows 9(*a* to *i*), whereupon the flow 9 is connected away from the device, the unit will then pump nine times as much fluid from the apparatus although the motion corresponds only to the movement of one cavity. Several small pump elements may be caused to act as one single large pump element and this is animated in FIG. 13,14,15,16.

In addition to this the embodiment shows how one can use the device to create a compressor with dynamic ratio. The device may be controlled by some sort of controlled coupling device (20), PLC (Programming Logic Controller) or any tight coupling device that can withstand the pressure. By for example, controlling so that flows 6*a*-*f* is short-circuited and connected to an input of the apparatus, in addition to this let 9(*a*-*f*) short-circuit and let this flow be connected to three short-circuited inlets 8(*g*-*i*) and then short-circuit the flows 7(*g*-*i*) and connect these to the output. By connecting in this way the six cavities (a-f) will be filled when the piston moves to the right, then when it moves to the left again this fluid (assume gas in this example) will be moved to the right side of the three cavities (g-i). Assuming that the cavities all have the same volume, gas will be moved from 6 volumes to 3, and therefore compressed the gas 6/3=2 times. By selecting different inputs/outputs to be short-circuit by the controller different compression ratios may be achieved.

In addition to this, the flows 8(*a-f*) may be short-circuited and also connect these to the device input, then short-circuit 7(*a-f*) and connect these to a flow that is linked to the short circuit flows 6(*g-i*) and also short-circuit flows 9(*g-i*) and also connect these to an output of the apparatus. Then there is a second flow that does the same compression as the previous one. This however fills the six cavities (a-f), from the input, when the piston moves to the left, then when it moves to the right again this gas will be moved to the left side of the three cavities g-i.

The magnitude of the compression is controlled by controlling how the individual pump elements are connected to each other. For example, a compression of 5/4 so would require short-circuiting 5 cavities from inputs and connecting to 4 directly connected cavities.

An alternative arrangement of the walls of the pump unit, not shown in the drawings would be to let the inner part have side walls, end stops and a top wall, forming a cavity. In this case, the outer part comprises a bottom element on which the piston wall is arranged so that when the inner part was placed over the outer part the piston wall extends into the cavity. Holes and connectors are arranged on the outer part and the inner part is driven to perform a scrolling movement whereby the cavity and the piston move relative to each other and the inner part alternatingly closes and exposes the holes on the outer part.

The invention claimed is:

1. A pump unit comprising an outer part and an inner part arranged so as to form a cavity, the cavity having a cavity opening formed by the outer part and the inner part, the pump unit further comprising a top element, said top element sealing the cavity opening and further comprising a piston wall extending through the cavity opening and into the cavity such that the cavity is divided into a first chamber and a second chamber separated by the piston wall, the piston wall sealing the first chamber and the second chamber from each other at a first end stop of the inner part and a second end stop of the inner part at opposite ends of the cavity, the outer part being fixed relative to the inner part and the top element and further comprising at least one inlet and at least one outlet, the top element being arranged to perform a scrolling movement whereby the inner part is caused to slide back and forth in a first direction relative to the outer part and the piston wall is caused to slide in a second direction relative to the inner part, wherein the second direction is perpendicular to the first direction, the first chamber fluidly coupled with the at least one inlet and the at least one outlet in such a way that the sliding of the inner part will cause the first inlet and the first outlet to be alternatingly closed and exposed by the inner part to achieve a pumping effect from the first inlet to the first outlet.

2. A pump unit according to claim 1, wherein, either the outer part or the inner part further comprise a first side wall forming a first side of the cavity, and a second side wall forming a second side of the cavity opposite the first side, and wherein either the outer part or the inner part further comprise a bottom element forming a bottom wall of the cavity, and wherein the first and second end stops extend between the first and second side walls, forming opposite ends of the cavity, and the scrolling movement causing the inner part to slide parallel to the first and second side walls, and the piston wall is caused to reciprocate between the first and second side walls, parallel to the first and second end stops.

3. A pump unit according to claim 1, wherein an element of the outer part further comprises a second inlet and a second outlet fluidly coupled with the second chamber, in such a way that the sliding of the inner part will cause the second inlet and the second outlet to be alternatingly closed and exposed by the inner part to achieve a pumping effect from the second inlet to the second outlet, respectively.

4. A pump unit according to claim 1, wherein the outer part further comprises a first side wall and a second side wall, and the at least one inlet and the at least one outlet, are arranged in the first and second side walls, respectively.

5. A pump unit according to claim 1, wherein the outer part further comprises a bottom element, and the at least one inlet and at least one outlet are arranged in the bottom element.

6. A pump unit according to claim 1, wherein the inner part is a box formed by four sides comprising a first side wall, a second side wall, the first end stop, and the second end stop, the four sides connected by a frame bottom, the side opposite the frame bottom being open, and wherein the outer part further comprises a bottom element on which the frame bottom slides.

7. A pump unit according to claim 5, wherein the inner part further comprises a first side wall and a second side wall and the outer part further comprises a first outer side wall and a second outer side wall arranged outside of the first side wall and the second side wall, respectively.

8. A pump unit according to claim 1, wherein the outer part further comprises a first side wall, a second side wall, and a bottom element, the at least one inlet, at least one outlet, the first end stop, and the second end stop being arranged so that the first end stop and the second end stop will alternatingly expose and close the at least one inlet and at least one outlet, respectively.

9. A pump unit according to claim 1, wherein the at least one inlet and/or the at least one outlet further comprise a number of holes.

10. A pump unit according to claim 1, wherein either the inner part or the outer part further comprises support elements or skids to reduce the friction between the inner part and the outer part.

11. A pump unit according to claim 9, wherein the inner part further comprises a frame bottom and the outer part comprises a bottom element on which the frame bottom slides, and either the frame bottom or the bottom element further comprises support elements or skids to reduce the friction between the frame bottom and the bottom element.

12. A pump unit according to claim 1, further comprising at least one wheel arranged so as to reduce friction between the outer part and the inner part.

13. A pumping device comprising at least a first pump unit and a second pump unit according to claim 1, at least one outlet of the first pump unit being connected to an inlet of the second pump unit.

14. A pumping device according to claim 13, wherein the top element of the first pump unit and the top element of the second pump unit are a single common top element comprising one piston wall for each pump unit.

15. A pumping device comprising a first series of pump units and a second series of pump units, each pump unit being a pump unit according to claim 1, said first series of pump units and said second series of pump units being interconnected to achieve a compression or an expansion.

* * * * *